US011112742B2

(12) United States Patent
Matsumoto

(10) Patent No.: US 11,112,742 B2
(45) Date of Patent: Sep. 7, 2021

(54) IMAGE FORMING APPARATUS TO DETECT WIDTHS OF RECORDING MATERIAL

(71) Applicant: CANON KABUSHIKI KAISHA, Tokyo (JP)

(72) Inventor: Shinichiro Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/921,714

(22) Filed: Jul. 6, 2020

(65) Prior Publication Data

US 2021/0011413 A1 Jan. 14, 2021

(30) Foreign Application Priority Data

Jul. 8, 2019 (JP) ..... JP2019-127062

(51) Int. Cl.
*G03G 15/00* (2006.01)
*G03G 15/16* (2006.01)

(52) U.S. Cl.
CPC ..... *G03G 15/5029* (2013.01); *G03G 15/6502* (2013.01); *B65H 2511/12* (2013.01); *B65H 2553/21* (2013.01); *G03G 15/1675* (2013.01); *G03G 15/556* (2013.01); *G03G 2215/00037* (2013.01); *G03G 2215/00734* (2013.01)

(58) Field of Classification Search
CPC ..... G03G 15/5029; G03G 15/6502; G03G 15/6594; G03G 2215/00734; G03G 2215/00383; B65H 2511/12; B65H 2553/21; B65H 2557/242; B65H 2701/113; B65H 2701/1315; B65H 2801/06;

(Continued)

(56) References Cited

U.S. PATENT DOCUMENTS 6,070,048 A * 5/2000 Nonaka ..... B65H 1/00 399/376
6,089,566 A * 7/2000 Xu ..... B65H 29/12 271/171

(Continued)

FOREIGN PATENT DOCUMENTS

JP H11-130271 A 5/1999
JP 2009102133 A * 5/2009

(Continued)

*Primary Examiner* — Robert B Beatty

(74) *Attorney, Agent, or Firm* — Canon U.S.A., Inc. I.P. Division

(57) ABSTRACT

An image forming apparatus includes a stack portion, a regulation portion, a detection unit, and a control unit. The regulation portion regulates a position of an edge of recording material stacked on the stack portion. The detection unit detects the position of the edge of the stacked and regulated recording material, and outputs a detection signal per the recording material edge detected position. Where the position of the recording material edge is detected, the control unit obtains a first width of the recording material stacked on the stack portion, calculates a second width of the recording material based on the detection signal output from the detection unit, and obtains a third width of the recording material by correcting a width of the recording material based on difference information between the second width of the recording material and the first width of the recording material.

11 Claims, 17 Drawing Sheets

(58) Field of Classification Search
CPC ..... B65H 2405/114; B65H 2405/1142; B65H 2405/11425
USPC ..... 399/45, 389; 271/171, 265.01
See application file for complete search history.

(56) References Cited

U.S. PATENT DOCUMENTS

| | | | | |
|---|---|---|---|---|
| 9,499,366 | B2 * | 11/2016 | Morikami | B65H 7/02 |
| 2003/0151188 | A1 * | 8/2003 | Imahara | B65H 1/00 271/171 |
| 2021/0009368 | A1 * | 1/2021 | Matsumoto | G03G 15/6555 |

FOREIGN PATENT DOCUMENTS

| | | | | |
|---|---|---|---|---|
| JP | 2010208824 | A | * | 9/2010 |
| JP | 2016-141511 | A | | 8/2016 |
| JP | 2019-156574 | A | | 9/2019 |

* cited by examiner

FIG. 7A
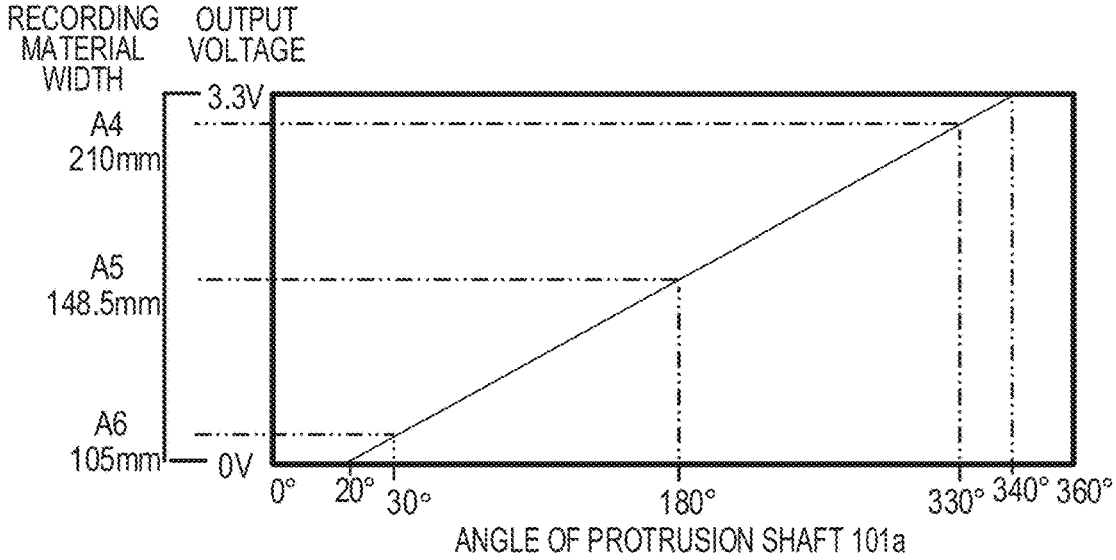
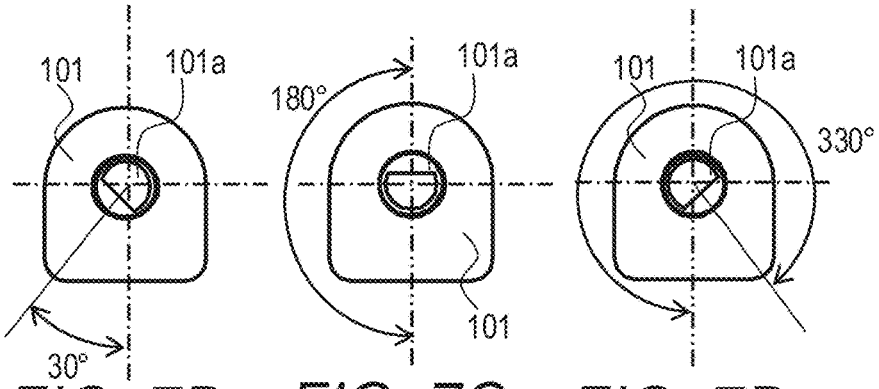
FIG. 7B FIG. 7C FIG. 7D
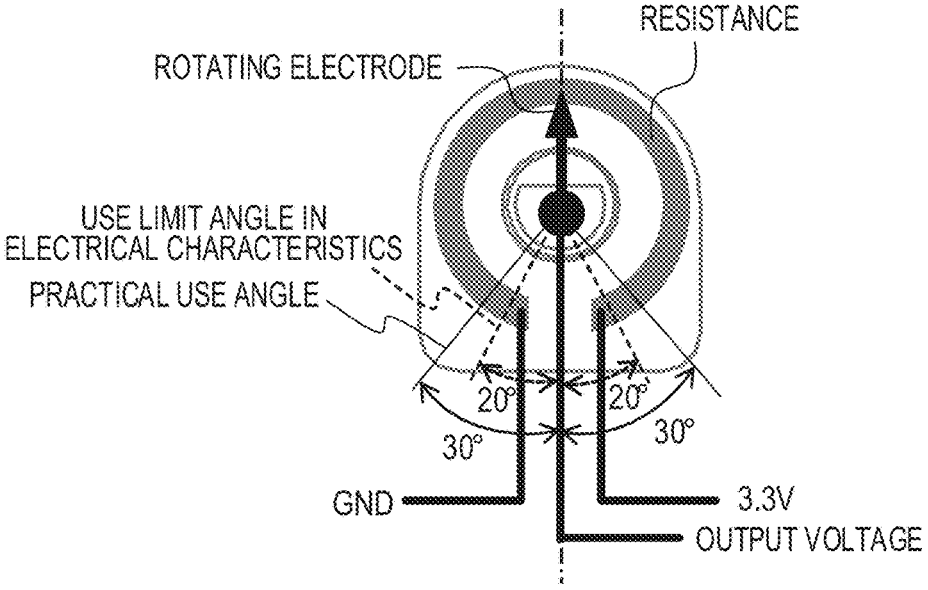
FIG. 7E

IMAGE FORMING APPARATUS TO DETECT WIDTHS OF RECORDING MATERIAL

BACKGROUND OF THE DISCLOSURE

Field of the Disclosure

The present disclosure relates to an image forming apparatus configured to detect a width of a recording material stacked in a stack portion.

Description of the Related Art

Various sizes of recording materials are used in an image forming apparatus. A recording-material width detector configured to detect a size of a recording material is provided in a feed tray configured to receive a recording material for the image forming apparatus. As a method of detecting a width of a recording material, which is used for the recording-material width detector, for example, the following method is proposed in Japanese Patent Application Laid-Open No. H11-130271. Specifically, positions of regulating members configured to regulate a position of a recording material placed in a feed tray are transmitted to a variable resistor via rack members and a pinion gear, and a resistance value of the variable resistor is changed in accordance with the positions of the regulating members. Then, the resistance value of the variable resistor is converted into a width of the recording material based on a voltage corresponding to the resistance value of the variable resistor, which has been changed in accordance with the positions of the regulating members.

SUMMARY OF THE DISCLOSURE

According to an aspect of the present disclosure, an image forming apparatus includes a stack portion on which recording material is to be stacked, a regulation portion configured to regulate a position of an edge of the recording material stacked on the stack portion, a detection unit configured to detect the position of the edge of the recording material stacked on the stack portion and regulated by the regulation portion, and to output a detection signal in accordance with the detected position of the recording material edge, and a control unit configured to control image formation on the recording material, wherein, in a case where the position of the recording material edge is detected, the control unit: obtains a first width of the recording material stacked on the stack portion, calculates a second width of the recording material based on the detection signal output from the detection unit, and obtains a third width of the recording material by correcting a width of the recording material based on difference information between the second width of the recording material and the first width of the recording material.

Further features of the present disclosure will become apparent from the following description of exemplary embodiments with reference to the attached drawings.

BRIEF DESCRIPTION OF THE DRAWINGS

FIG. 7A is a graph and FIG. 7B, FIG. 7C, FIG. 7D and FIG. 7E are views for illustrating an operation of the recording-material width sensor according to the embodiment.

DESCRIPTION OF THE EMBODIMENTS

Now, detailed description is made of embodiments of the present disclosure with reference to the drawings. However, the dimensions, materials, shapes, relative positional relationship, and the like of structural elements described herein should be appropriately changed depending on the structure of the apparatus to which the present disclosure is applied and various conditions. Specifically, these are not meant to limit the scope of the present disclosure to the following embodiments.

[Configuration of Image Forming Apparatus]

Figure 1:
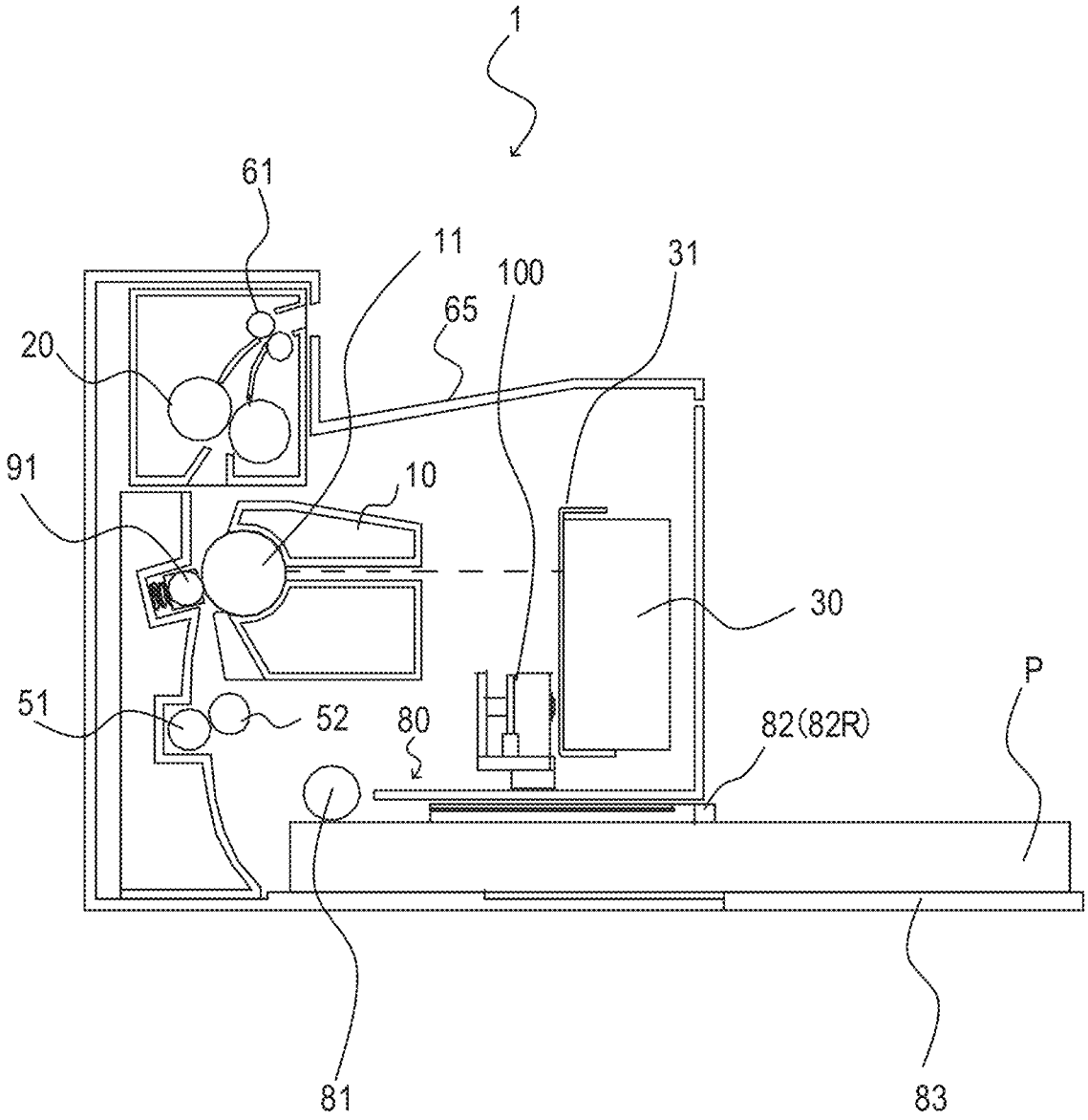
FIG. 1 is a sectional view for illustrating a configuration of an image forming apparatus according to an embodiment.

First, an overall configuration of an image forming apparatus to which the present disclosure is applied is described with reference to FIG. 1. FIG. 1 is a sectional view for illustrating a configuration of a laser beam printer 1 (hereinafter referred to as "printer 1") corresponding to one mode of the image forming apparatus according to this embodiment. In the printer 1 illustrated in FIG. 1, a feeding portion 80 configured to receive a recording material P, which is a recording medium, is arranged in a lowermost stage. On a left side of the feeding portion 80 in FIG. 1, a registration roller 51, and a registration counter roller 52 are arranged. The registration roller 51 and the registration counter roller 52 are configured to align a position of a leading edge of the recording material P, which has been conveyed from the feeding portion 80, with a toner image and convey the recording material P to a transfer roller 91.

Above the feeding portion 80 in FIG. 1, a recording-material width detection unit 100 and a laser scanner unit 30 are arranged. The recording-material width detection unit 100 is configured to detect a width, which is a length orthogonal to a conveying direction (direction from the right to the left of FIG. 1) of the recording material P. The laser scanner unit 30 is configured to form an electrostatic latent image on a photosensitive drum 11. A scanner frame 31 is arranged on a left side of the laser scanner unit 30 in FIG. 1. The laser scanner unit 30 is fixed to the scanner frame 31. On a left side of the scanner frame 31 in FIG. 1, a process cartridge 10 is arranged. The process cartridge 10 includes the photosensitive drum 11 and a developing device (not shown). The photosensitive drum 11 is exposed to a light beam emitted from the laser scanner unit 30 in accordance with image information to form an electrostatic latent image thereon. The developing device is configured to develop the electrostatic latent image formed on the photosensitive drum 11 to form a toner image. On a left side of the process cartridge 10 in FIG. 1, the transfer roller 91 configured to transfer the toner image formed on the photosensitive drum 11 onto the recording material P is provided at such a position as to be opposed to the process cartridge 10. Further, above the process cartridge 10 and the transfer roller 91 in FIG. 1, a fixing unit 20 configured to fix the toner image, which has been transferred to the recording material P, on the recording material P is arranged. On an upper right side of the fixing unit 20 in FIG. 1, a delivery roller pair 61 configured to deliver the recording material P, which has been conveyed from the fixing unit 20, to a delivery tray 65 is provided. Further, a CPU 106 (FIG. 11), which corresponds to a control unit, is included in a control portion (not shown) configured to control image formation to be performed on the recording material P, and is configured to collectively control an image formation operation of the printer 1.

[Image Formation Operation]

First, a user sets the recording material P in a feed tray 83, which corresponds to a stack portion configured to stack the recording material P of FIG. 1 therein, so as to perform the image formation on the recording material P. At this time, the user moves (slides) side regulating plates 82 (82R, 82L (FIG. 6)), which correspond to a regulation portion configured to regulate a magnitude of the width orthogonal to the conveying direction of the recording material P, to positions in accordance with the width of the recording material P. After that, when print data including, for example, a printing instruction and the image information is input to the CPU 106 from, for example, an external host computer (not shown), a printing operation on the recording material P is started. Through control of the CPU 106, the recording material P is first fed from the feed tray 83 by a feed roller 81, and is conveyed to the registration roller 51 and the registration counter roller 52. Further, the CPU 106 controls the laser scanner unit 30 based on the image information in parallel to conveyance control for the recording material P to form an electrostatic latent image on the photosensitive drum 11, and controls the developing device to form a toner image on the photosensitive drum 11. Then, the CPU 106 controls the registration roller 51 and the registration counter roller 52 to rotate in synchronization with timing of transferring the toner image formed on the photosensitive drum 11 onto the transfer roller 91 to thereby convey the recording material P to the transfer roller 91. In this manner, the recording material P is conveyed to a nip portion formed between the photosensitive drum 11 and the transfer roller 91, which are in abutment against each other. The toner image formed on the photosensitive drum 11 is transferred onto the recording material P at the nip portion. The toner image, which has been transferred onto the recording material P, is heated and pressurized by the fixing unit 20 including, for example, a fixing roller to be molten and fixed onto the recording material P. Then, the recording material P carrying the toner image fixed thereon is delivered by the delivery roller pair 61 to the delivery tray 65, and the image forming operation is terminated.

[Configuration of Recording-Material Width Detection Unit]

Figure 2:
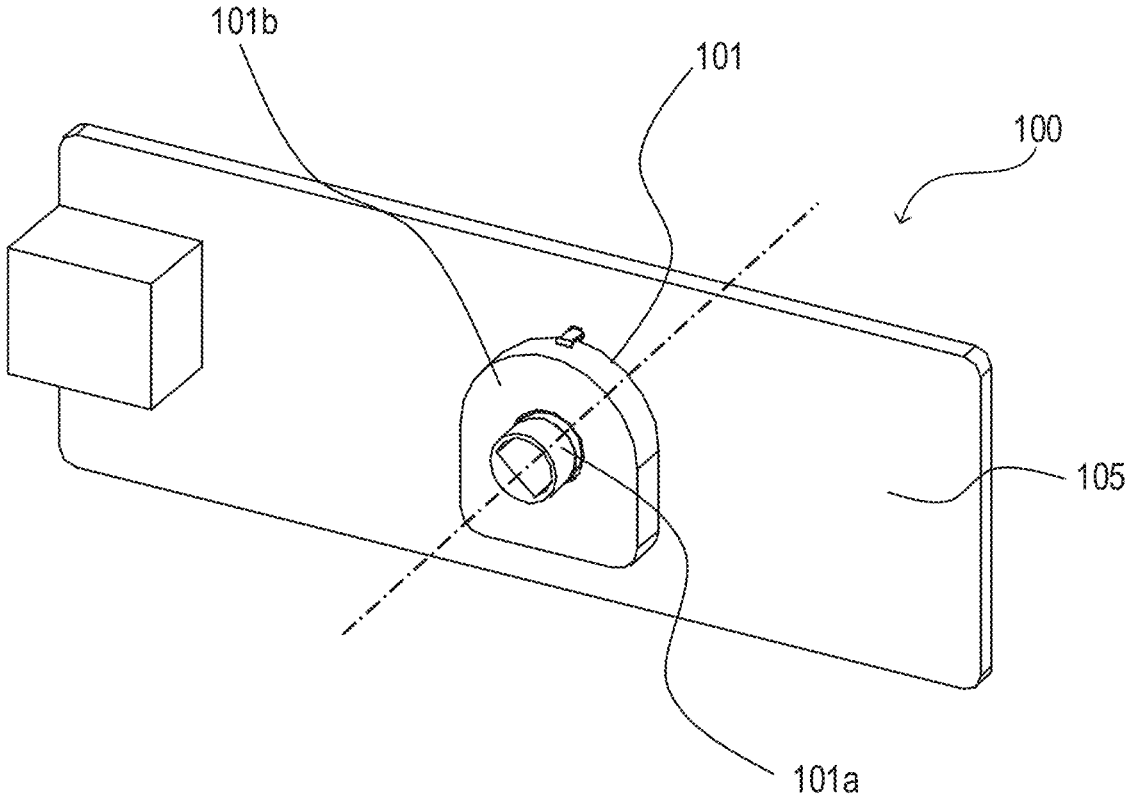
FIG. 2 is a perspective view for illustrating configurations of a recording-material width sensor and a printed board according to the embodiment.

FIG. 2 is a perspective view for illustrating configurations of a recording-material width sensor 101 (hereinafter referred to as "width sensor 101") and a printed board 105 in the recording-material width detection unit 100 illustrated in FIG. 1. The width sensor 101 is configured to detect the width of the recording material P received in the feed tray 83. The width sensor 101 is mounted onto the printed board 105. As illustrated in FIG. 2, the width sensor 101 corresponding to a detection unit includes a protrusion shaft 101*a* and a sensor main body 101*b*. The protrusion shaft 101*a* has a hole formed in a center, and is mounted so as to be rotatable with respect to the sensor main body 101*b*. Meanwhile, the sensor main body 101*b* is a variable resistor of a rotary type, and is fixed onto the printed board 105 under an electrically connected state. The sensor main body 101*b* includes a resistance (not shown), and has a resistance value changed in accordance with a rotation angle of the protrusion shaft 101*a*. The width sensor 101 converts the resistance value of the sensor main body 101*b* corresponding to the variable resistor into a voltage corresponding to a detection signal, and outputs the voltage to the CPU 106 (FIG. 11) of the control portion (not shown).

Figure 3A:
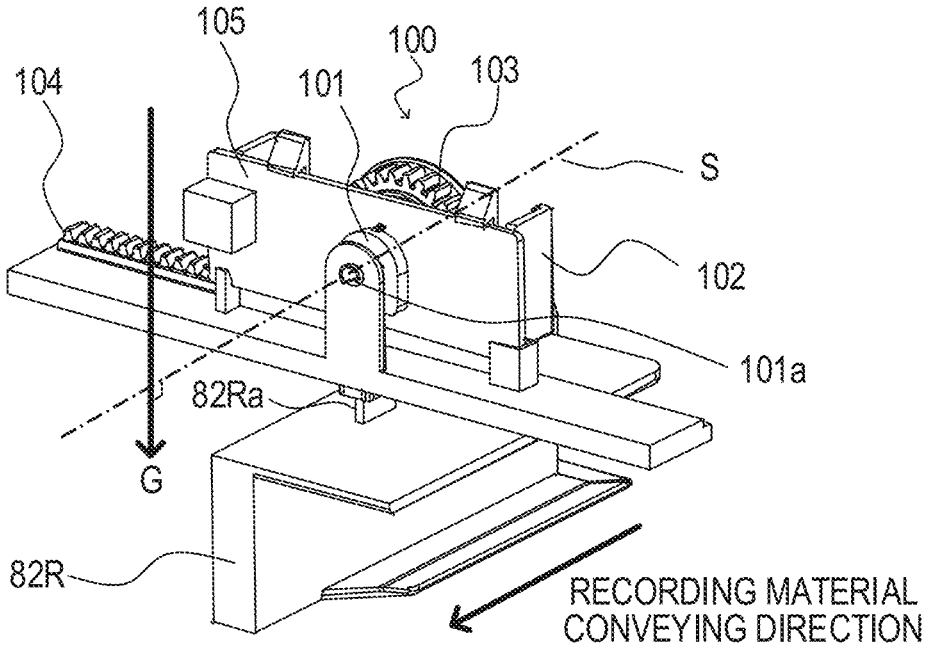
FIG. 3A and FIG. 3B are perspective views, each for illustrating a configuration of a recording-material width detection unit and a relationship between the recording-material width detection unit and a side regulating plate according to the embodiment.
Figure 3B:
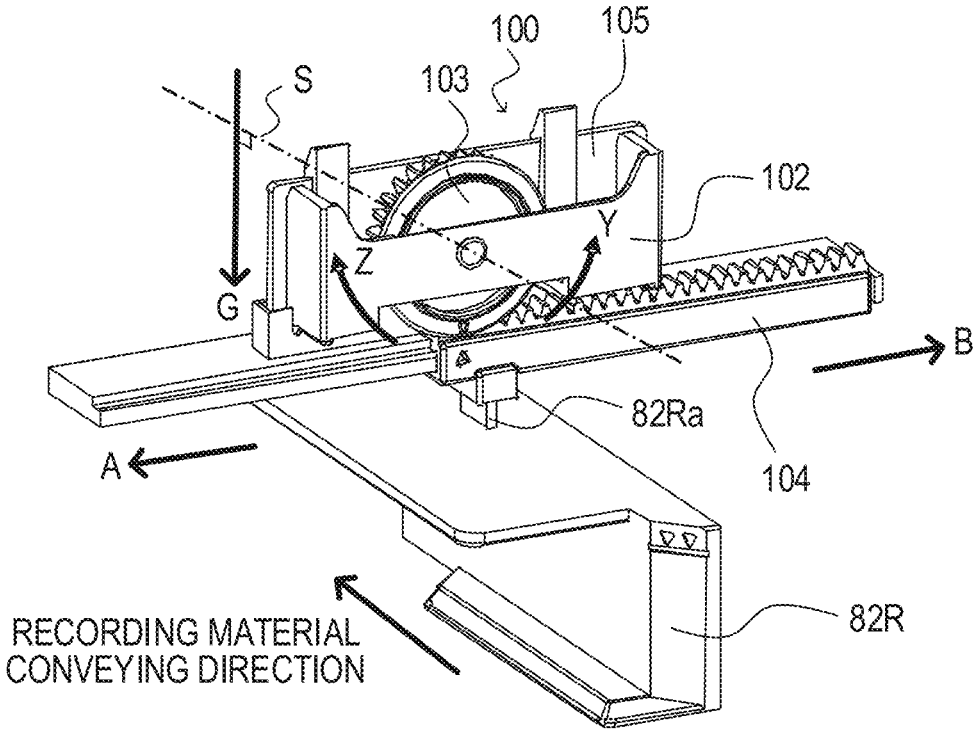

FIG. 3A and FIG. 3B are perspective views, each for illustrating a configuration of the recording-material width detection unit 100 and a relationship between the recording-material width detection unit 100 and the side regulating plate 82 (82R). FIG. 3A is a perspective view of the recording-material width detection unit 100 and the side regulating plate 82 (82R) when viewed from a downstream side in the conveying direction of the recording material P received in the feed tray 83. As illustrated in FIG. 3A, the printed board 105, onto which the width sensor 101 is mounted, is mounted to a width sensor holder 102. The printed board 105 is fixed to the width sensor holder 102 in the following manner. Specifically, the printed board 105 is arranged so that a center line S (indicated by an alternate long and short dash line in FIG. 3A) of the protrusion shaft 101*a* of the width sensor 101 is substantially perpendicular to a gravity direction (G direction of FIG. 3A) and is substantially orthogonal to the conveying direction of the recording material P received in the feed tray 83. Further, a sensor gear 103 configured to be rotated in accordance with a motion of the side regulating plate 82 (82R) is provided on a side of the printed board 105, which is opposite to a surface on which the width sensor 101 is mounted.

FIG. 3B is a perspective view of the recording-material width detection unit 100 and the side regulating plate 82 (82R) when viewed from an upstream side in the conveying direction of the recording material P received in the feed tray 83. As illustrated in FIG. 3B, the sensor gear 103 is mounted on the surface of the printed board 105, which is opposite to the surface on which the width sensor 101 is mounted. The sensor gear 103 has a rotary shaft 103*a* (not shown in FIG. 3B). The rotary shaft 103*a* is fitted into the hole formed in the protrusion shaft 101*a* of the width sensor 101. The sensor gear 103 is rotatably mounted to the width sensor holder 102. A sensor rack 104 is connected to the side regulating plate 82R (first regulating member) through intermediation of a protrusion 82Ra. When the side regulating plate 82R is slid to a position of a corresponding edge of the recording material P in a width direction of the recording material P after the reception of the recording material P in the feed tray 83, the sensor rack 104 is also slid in association with the motion of the side regulating plate 82R. For example, when the side regulating plate 82R is moved in a direction A of FIG. 3B, the sensor rack 104 is also slid in the direction A. At the same time, the sensor gear 103 is rotated in a direction Z of FIG. 3B. Meanwhile, when the side regulating plate 82R is moved in a direction B of FIG. 3B, the sensor rack 104 is also slid in the direction B. At the same time, the sensor gear 103 is rotated in a direction Y of FIG. 3B.

Figure 4:
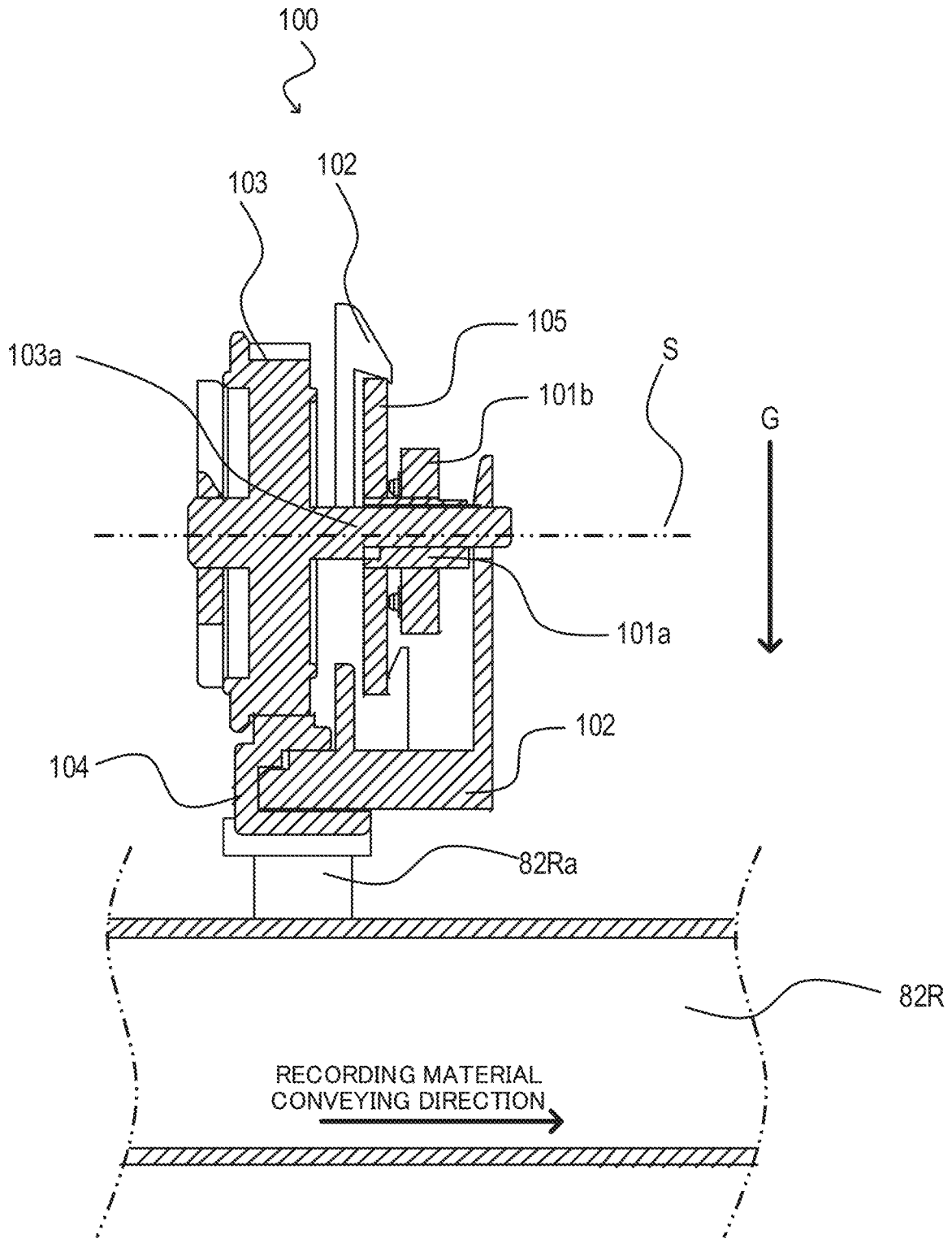
FIG. 4 is a sectional view for illustrating the configuration of the recording-material width detection unit and the relationship between the recording-material width detection unit and the side regulating plate according to the embodiment.

FIG. 4 is a sectional view for illustrating the configuration of the recording-material width detection unit 100 and the relationship between the recording-material width detection unit 100 and the side regulating plate 82 (82R). FIG. 4 is an illustration of a cross section of the recording-material width detection unit 100 and the side regulating plate 82R, which is taken so as to pass through a center of the rotary shaft 103*a* of the sensor gear 103, when viewed in a leftward direction from the right side of FIG. 3B. As illustrated in FIG. 4, the printed board 105 is fixed to the width sensor holder 102. Further, one end of the rotary shaft 103*a* of the sensor gear 103 is rotatably supported by the width sensor holder 102, and another end thereof is fitted into the hole formed in the protrusion shaft 101*a* of the width sensor 101 mounted onto the printed board 105. With the configuration described above, the protrusion shaft 101*a* is rotated in the direction Y and the direction Z of FIG. 3B, in association with the rotation of the rotary shaft 103*a* of the sensor gear 103. Further, the side regulating plate 82R is connected to the sensor rack 104 through intermediation of the protrusion 82Ra of the side regulating plate 82R. Further, the sensor rack 104 is mounted to the width sensor holder 102 so as to transmit the motion (movement) of the side regulating plate 82R to the sensor gear 103. As a result, the sensor rack 104 is also movable in the direction A and the direction B of FIG. 3B, in association with the movement of the side regulating plate 82R in the direction A and the direction B, which are orthogonal to the conveying direction of the recording material P.

Figure 5:
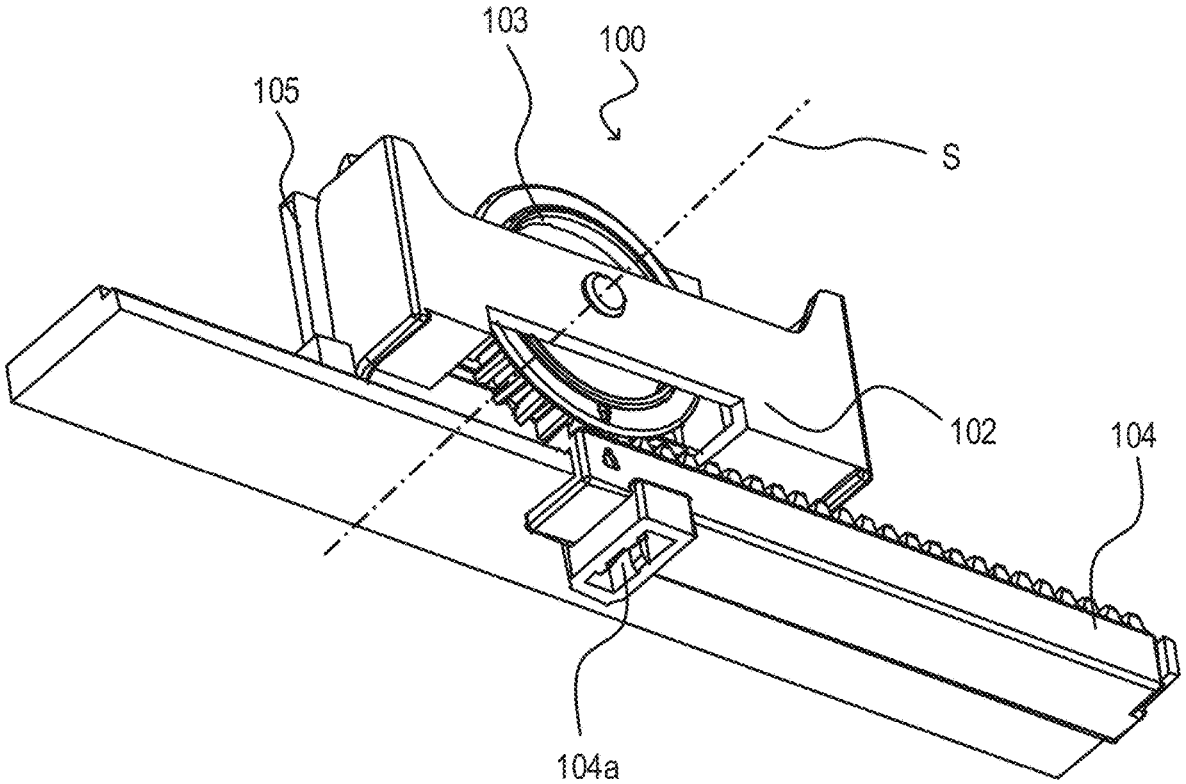
FIG. 5 is a perspective view for illustrating the recording-material width detection unit according to the embodiment when viewed from a feed tray side.

FIG. 5 is a perspective view of the recording-material width detection unit 100 when viewed from the feed tray 83 side. As illustrated in FIG. 5, a grooved portion 104*a* configured to fit to the protrusion 82Ra of the side regulating plate 82R is provided on a lower side of the sensor rack 104. Meanwhile, as illustrated in FIG. 3B, the protrusion 82Ra is formed on a side of the side regulating plate 82R, which is opposed to the sensor rack 104. When the grooved portion 104*a* and the protrusion 82Ra are fitted together, the side regulating plate 82R and the sensor rack 104 are coupled to each other. In this manner, the sensor rack 104 is configured to be movable in synchronization with the movement of the side regulating plate 82R. Further, as illustrated in FIG. 5, teeth of the sensor gear 103 are meshed with teeth of the sensor rack 104. Thus, when the sensor rack 104 is moved in synchronization with the movement of the side regulating plate 82R, the sensor gear 103 is also rotated in association with the movement of the sensor rack 104.

[Operation of Recording-Material Width Detection Unit]

Figure 6:
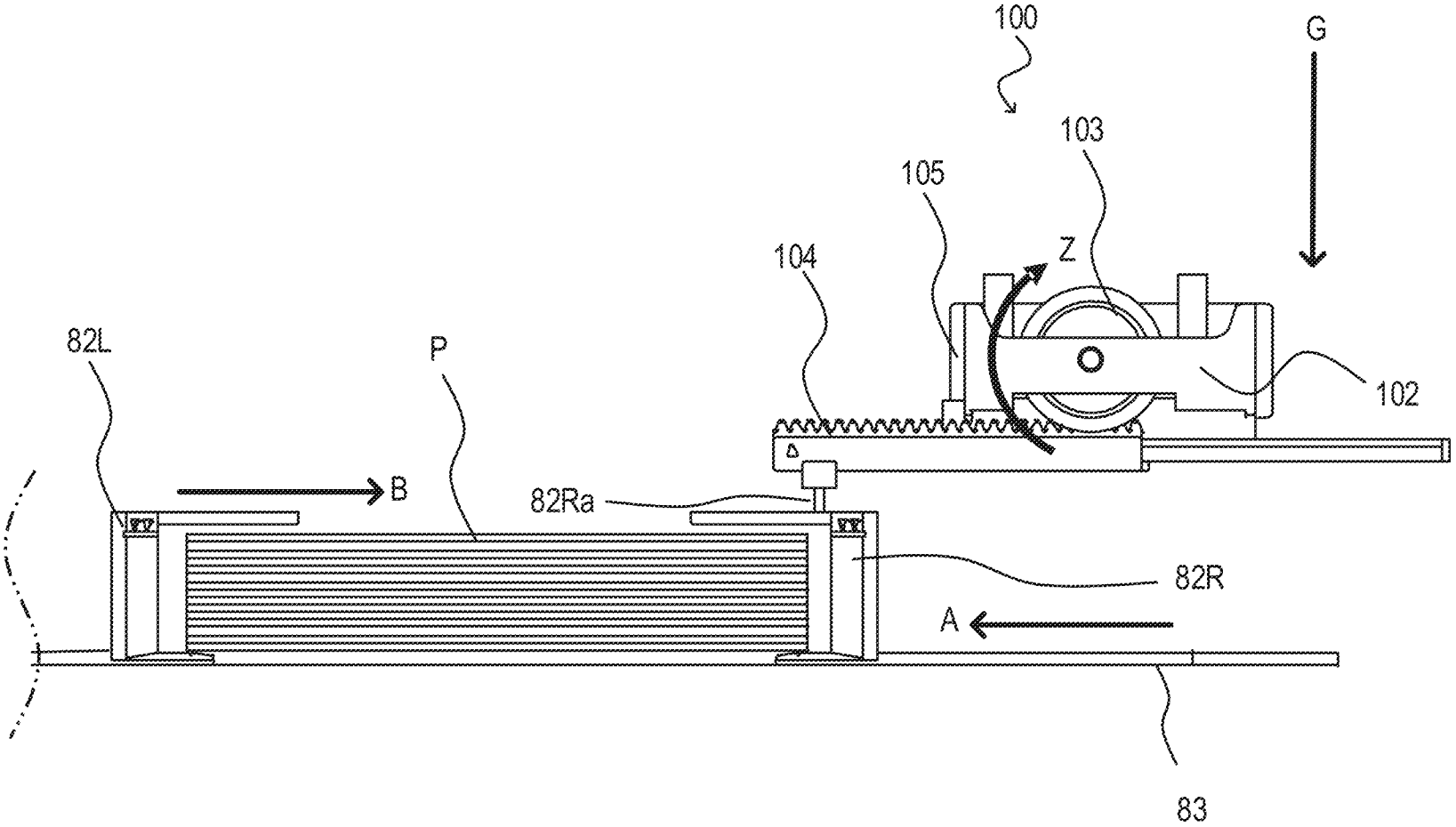
FIG. 6 is a view for illustrating an operation of the recording-material width detection unit according to the embodiment.

FIG. 6 is a view for illustrating an operation of the recording-material width detection unit 100 when the recording material P is set in the feed tray 83. FIG. 6 is a view for illustrating a configuration of the feed tray 83 and the configuration of the recording-material width detection unit 100, which are illustrated in FIG. 1, when viewed in a leftward direction from the right side of FIG. 1. In FIG. 6, a user moves the side regulating plate 82R in a rightward direction in FIG. 6 so as to set the recording material P in the feed tray 83. Then, after setting the recording material P in the feed tray 83, the user moves the side regulating plate 82R in the direction A to a position at which the side regulating plate 82R abuts against a corresponding edge of the recording material P in the width direction. The side regulating plates 82 includes one pair of right and left side regulating plates, specifically, the side regulating plate 82R (right side) and the side regulating plate 82L (left side). When one of the side regulating plates 82 is slid, another one thereof is also slid in a symmetric manner with use of a pinion (not shown). Thus, the recording material P can be regulated in the width direction on the right side and the left side at the same time.

In FIG. 6, when the side regulating plate 82R is slid (moved) in the direction A, the side regulating plate 82L (second regulating plate) is slid in the direction B that is opposite to the sliding direction (operating direction) of the side regulating plate 82R in association with the motion of the side regulating plate 82R. At this time, when the side regulating plate 82R is moved in the direction A, the sensor rack 104, which is coupled to and integrated with the side regulating plate 82R through intermediation of the grooved portion 104*a* and the protrusion 82Ra, is also moved in the direction A. Then, through the movement of the sensor rack 104 in the direction A, the sensor gear 103 having the teeth meshed with the teeth of the sensor rack 104 is rotated in the direction Z. As a result, the protrusion shaft 101*a* (not shown in FIG. 6) of the width sensor 101 (not shown in FIG. 6), into which the rotary shaft 103*a* (not shown in FIG. 6) of the sensor gear 103 is fitted, is also rotated in the direction Z. The width sensor 101 converts the resistance value of the variable resistor corresponding to the sensor main body 101*b* in accordance with the rotation angle of the protrusion shaft 101*a* into a voltage, and outputs the voltage to the CPU 106 (FIG. 11) of the control portion (not shown).

(Operation without Static Error and Dynamic Error)

Next, an ideal operation of the recording-material width detection unit 100 is described. In this case, the "ideal operation" corresponds to an operation without a "static error" corresponding to an error generated due to a component tolerance described later or a "dynamic error" corresponding to an error generated due to idling of a component.

FIG. 7A is a graph for showing a relationship between the rotation angle of the protrusion shaft 101*a* of the width sensor 101 and the width of the recording material P. In FIG. 7A, the horizontal axis represents the rotation angle (in degree (°)) of the protrusion shaft 101*a*, and the vertical axis represents an output voltage (in volt (V)) of the width sensor 101 and the width of the recording material (sheet size and width of the recording material P), which corresponds to the output voltage. It can be understood from FIG. 7A that the resistance value of the variable resistor is increased as the rotation angle of the protrusion shaft 101*a* increases and that the output voltage of the width sensor 101 is also increased in proportion to the increase in resistance value. In this embodiment, the output voltage is set so as to indicate that the width of the recording material P is equal to a width of A6 size (105 mm) when the rotation angle of the protrusion shaft 101*a* is 30° and indicate that the width of the recording material P is equal to a width of A4 size (210 mm) when the rotation angle of the protrusion shaft 101*a* is 330°. As described above, when the rotation angle of the protrusion shaft 101*a* is linearly changed, the width of the recording material P can also be linearly detected.

FIG. 7B, FIG. 7C, and FIG. 7D are views for illustrating a state of the protrusion shaft 101*a* of the width sensor 101 when the rotation angle of the protrusion shaft 101*a* is 30°, 180°, and 330°, respectively. The recording material P illustrated in FIG. 6 has the A6 size, and the protrusion shaft 101*a* of the width sensor 101 is in a state of being located at a position of FIG. 7B. In FIG. 6, when the side regulating plate 82R is slid to the position of the corresponding edge of the recording material P in the width direction, the rotation angle of the protrusion shaft 101*a* is 30°. When the width of the recording material P is calculated based on the rotation angle of the protrusion shaft 101*a*, 105 mm, which corresponds to the width of the A6 size, is obtained as the width of the recording material P. When the side regulating plate 82R is slid in the direction B (rightward direction) from a state of FIG. 6, the rotation angle of the protrusion shaft 101*a* is increased in accordance with a sliding amount to be changed from the rotation angle of FIG. 7B to that of FIG. 7C and then from the rotation angle of FIG. 7C to that of FIG. 7D. With the change in rotation angle of the protrusion shaft 101*a*, the voltage output from the width sensor 101, which corresponds to the rotation angle of the protrusion shaft 101*a*, also increases. Thus, a larger width of the recording material P is detected by the CPU 106.

In FIG. 7A, the output voltage is not shown in a section in which the rotation angle of the protrusion shaft 101*a* falls within a range of from 0° to 20° and a section in which the rotation angle of the protrusion shaft 101*a* falls within a range of from 340° to 360°. This is because the above-mentioned sections are not included in a use range of the width sensor 101 in electrical characteristics. FIG. 7E is a view for illustrating a configuration of the variable resistor of the width sensor 101. The sensor main body 101*b* of the width sensor 101 includes the resistance corresponding to a resistor and a rotating electrode. The rotating electrode is configured to be rotated in accordance with the rotation angle of the protrusion shaft 101*a* of the width sensor 101, into which the rotary shaft 103*a* of the sensor gear 103 is fitted. The width sensor 101 outputs a voltage of 0 V (GND) when a rotation angle of the rotating electrode is 200 and outputs a voltage of 3.3 V when the rotation angle of the rotating electrode is 340°. In the width sensor 101, a practical use angle of the rotating electrode falls within a range of from 300 to 330° (=360°−30°). Further, in the width sensor 101, use limit angles in electrical characteristics are 200 and 340° (=360°−20°). When the rotation angle of the rotating electrode is less than 20° or larger than 340°, the voltage is not output.

Thus, in FIG. 7A, the rotation angle of the protrusion shaft 101*a*, which corresponds to a detectable minimum width of the recording material P for the width sensor 101, is set to 30°. Thus, a mechanical margin of 10° is set for the angle of 20°, which is the use limit angle of the width sensor 101 in electrical characteristics. Similarly, for a maximum width of the recording material P, the rotation angle of the protrusion shaft 101*a*, which corresponds to a detectable maximum width of the recording material P for the width sensor 101, is set to 330°. Thus, a mechanical margin of 10° is set for the angle of 340°, which is the use limit angle of the width sensor 101 in electrical characteristics.

As described above, when one of the side regulating plates 82R and 82L is slid, another one thereof is also slid in a symmetric manner in association with the sliding of the one of the side regulating plates 82R and 82L. Thus, a sliding amount of each of the side regulating plates 82R and 82L is equal to or smaller than half of a difference value obtained by subtracting the minimum width of the recording material P from the maximum width thereof, which are detectable by the width sensor 101. Further, the sliding amount corresponds to a sliding amount of the sensor rack 104.

In this case, a pitch circumferential length of the sensor gear 103 is set equal to a sum of a maximum sliding amount N and a length of an arc for the angle (20°), which is the use limit angle of the width sensor 101 in electrical characteristics. For example, as shown in FIG. 7A, when the maximum width of the recording material P is set to 210 mm of the A4 size and the minimum width of the recording material P is set to 105 mm of the A6 size, the maximum sliding amount N is obtained as 52.5 mm (=(210 mm−105 mm)/2). Further, the rotation angle 300° (=330°−30°) of the sensor gear 103 corresponds to 52.5 mm. Thus, the pitch circumferential length of the sensor gear 103 is equal to or larger than 63 mm (=52.5 mm×(360°/300°)). When it is assumed that a module of the sensor gear 103 is one, the number of teeth is set to twenty-one or larger.

(Operation with Static Error and Dynamic Error)

Figure 8:
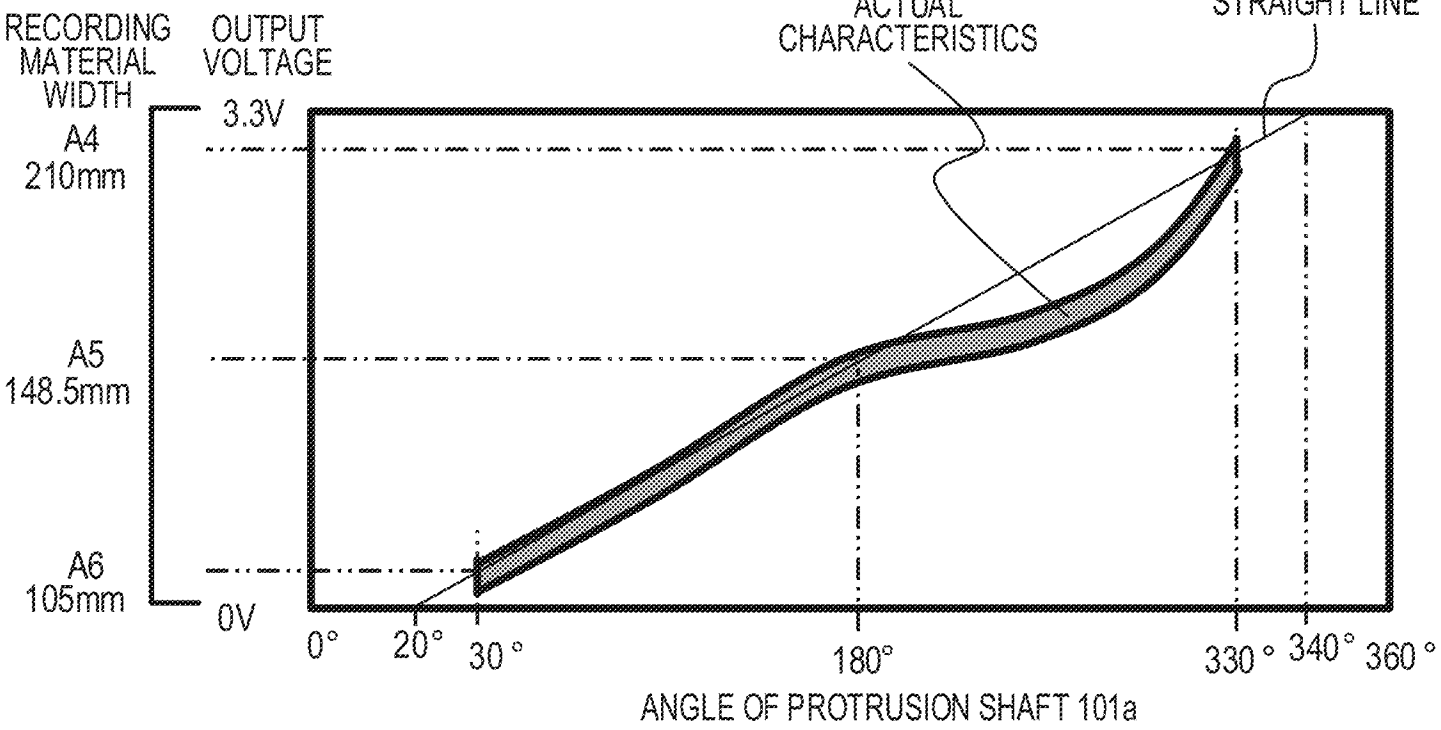
FIG. 8 is a graph for showing a relationship between a rotation angle of a protrusion shaft of the recording-material width sensor according to the embodiment and a width of a recording material.

Subsequently, an operation of the recording-material width detection unit 100 with the "static error" and the "dynamic error" is described. FIG. 8 is a graph corresponding to a combination of the graph of FIG. 7A referred to above and a graph of the rotation angle of the protrusion shaft 101*a* and the output voltage of the width sensor 101 with the "static error" and the "dynamic error" (indicated as a gray region in FIG. 8). In FIG. 8, "IDEAL STRAIGHT LINE" is a line representing a relationship between the rotation angle of the protrusion shaft 101*a* and the output voltage of the width sensor 101 without the "static error" or the "dynamic error", which has been described with reference to FIG. 7A. Meanwhile, the gray region "ACTUAL CHARACTERISTICS" corresponding to a range within which the output voltage may fall represents a relationship between the rotation angle of the protrusion shaft 101*a* and the output voltage of the width sensor 101 with the "static error" and the "dynamic error". In the region "ACTUAL CHARACTERISTICS", even when the rotation angle of the protrusion shaft 101*a* is the same, the output voltage of the width sensor 101 may be different due to the "dynamic error" as described later. Further, as described later, an error of the output voltage with respect to the output voltage indicated by the ideal straight line is different in accordance with a direction of sliding the side regulating plates 82.

Figure 9:
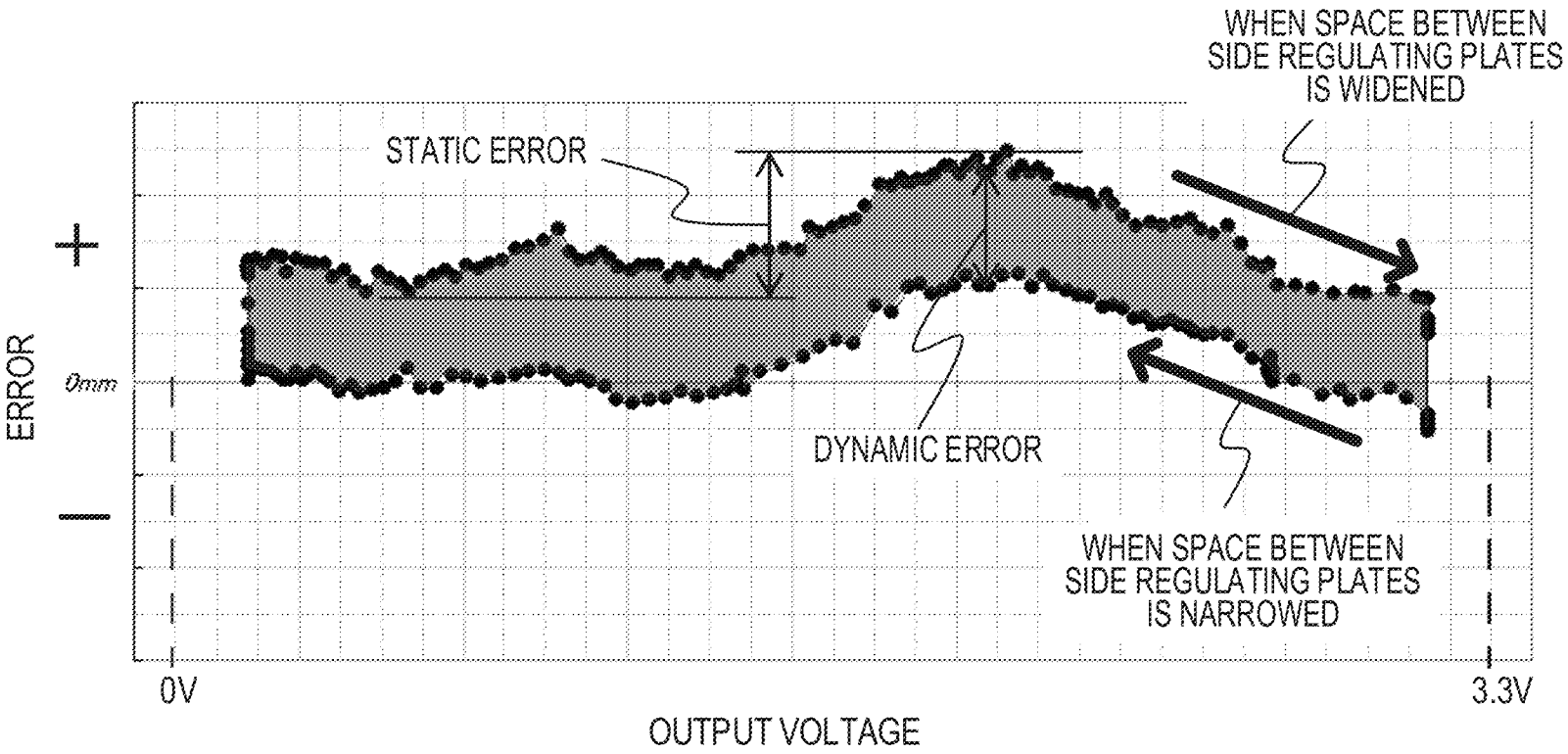
FIG. 9 is a graph for showing an error between an output voltage of the recording-material width sensor according to the embodiment and an actual recording material width.

FIG. 9 is a graph obtained by converting the graph of FIG. 8 for simplification of the description. The vertical axis represents a shift amount from the output voltage indicated by the ideal straight line, specifically, the error of the output voltage, and the horizontal axis represents the output voltage of the width sensor 101. The graph of FIG. 9 has two curves. One of the curves (lower curve in FIG. 9) is obtained when the side regulating plates 82R and 82L are moved in a direction of narrowing a space (distance) between the side regulating plates 82R and 82L from a maximum width side of the recording material P (3.3 V side of the output voltage of the width sensor 101) toward a minimum width side (0 V side of the output voltage). Another one of the curves (upper curve in FIG. 9) is obtained when the side regulating plates 82R and 82L are moved in a direction of widening the space between the side regulating plates 82R and 82L from the minimum width side (0 V side) of the recording material P toward the maximum width side (3.3 V side). The two curves have substantially the same shape, and have a parallel translation relationship in a vertical direction in FIG. 9. The gray region between the two curves represents a region of the error of the output voltage, which may be generated between the two curves. In FIG. 9, the error generated under a state in which a detected recording material width is small even though a true recording material width is large, specifically, the output voltage represented as "IDEAL STRAIGHT LINE" of FIG. 8 is larger than the output voltage represented as "ACTUAL CHARACTERISTICS" is indicated on a positive (+) side. Meanwhile, in FIG. 9, the error generated under a state in which the detected recording material width is large even though the true recording material width is small, specifically, the output voltage represented as "IDEAL STRAIGHT LINE" of FIG. 8 is smaller than the output voltage represented as "ACTUAL CHARACTERISTICS" is indicated on a negative (−) side.

In FIG. 9, a difference between a peak and a valley of each of the curves corresponds to the "static error" described above (in FIG. 9, the "static error" is indicated only for the upper curve as "STATIC ERROR"). The "static error" is generated due to a dimensional tolerance of an intermediate component or a tolerance of a change amount of the resistance value with respect to a rotation amount of the protrusion shaft of the variable resistor. Meanwhile, a parallel translation amount between the two curves shown in FIG. 9 in the vertical direction corresponds to the "dynamic error" described above. Even though the side regulating plates 82 are slid, the variable resistor of the width sensor 101 remains unoperated due to the following factors. Specifically, the variable resistor remains unoperated due to, for example, a gap corresponding to an assembly play between intermediate components provided so as to transfer the movement (sliding) of the side regulating plates 82 to the variable resistor, a backlash between gears meshing with each other, or deflection (deformation) of each of the components, which is caused by a force applied to the side regulating plates 82. As a result, even though the side regulating plates 82 are slid, the motion of the side regulating plates 82 is not transmitted to the variable resistor. As a result, "idling" occurs, specifically, the variable resistor of the width sensor 101 is not operated. The "dynamic error" is generated due to the idling of the above-mentioned intermediate component.

Figure 10:
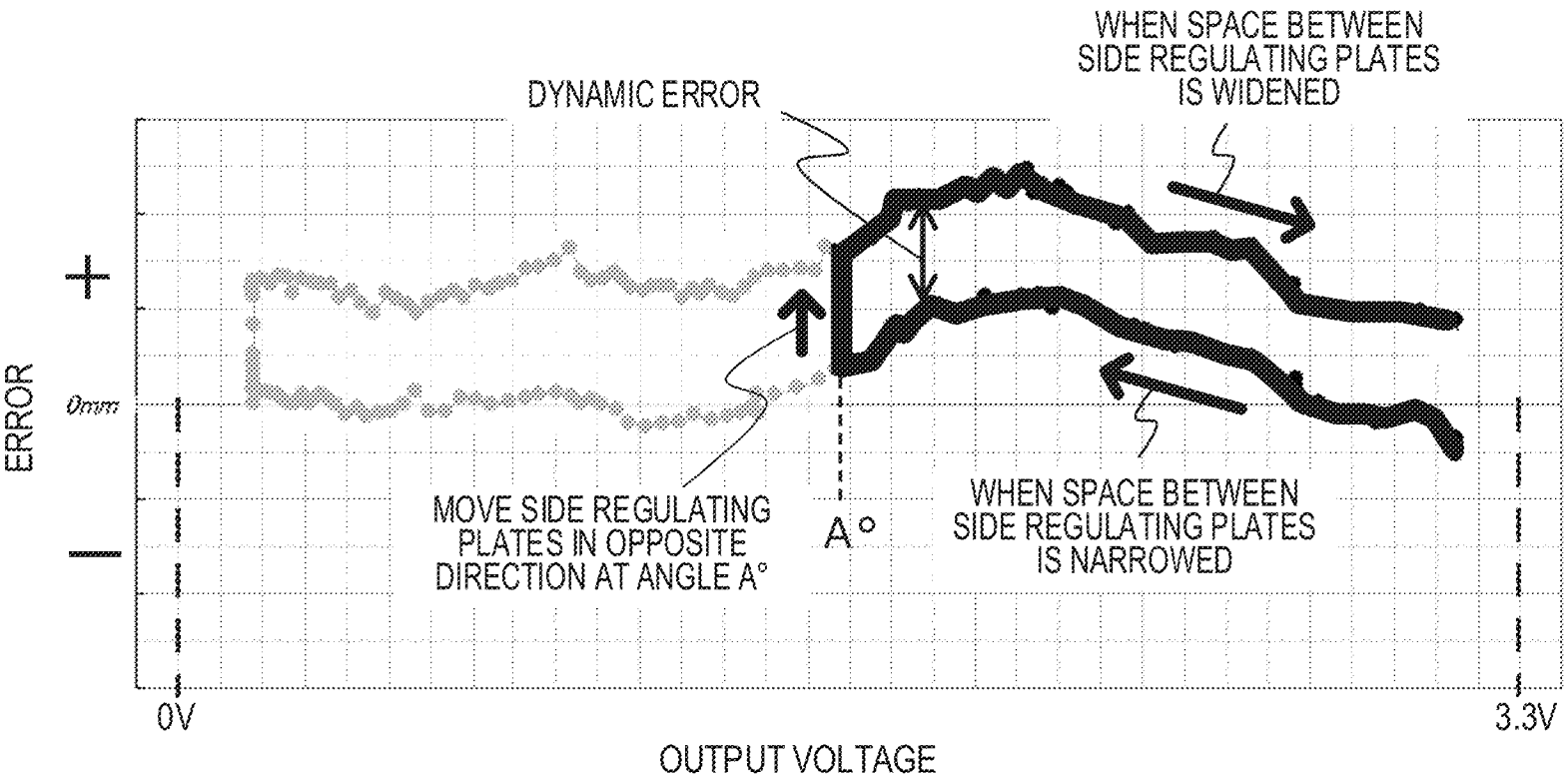
FIG. 10 is a graph for showing a dynamic error in output voltage of the recording-material width sensor according to the embodiment.

Next, the "dynamic error" is described with reference to the drawing. FIG. 10 is a graph when the side regulating plates 82 are first moved in the direction of narrowing the space between the side regulating plates 82R and 82L from the maximum width side (3.3 V side) of the recording material P and are reversed at a position at which the rotation angle of the protrusion shaft 101*a* is A° so as to be slid in the direction of widening the space between the side regulating plates 82R and 82L. The vertical axis and the horizontal axis of FIG. 10 are the same as those of FIG. 9, and description thereof is herein omitted. When the side regulating plates 82 are slid in the direction of narrowing the space between the side regulating plates 82R and 82L, for example, the assembly play between the intermediate components, the backlash between the gears meshing with each other, or the deflection of the component, which is caused by the force applied to the side regulating plates 82, is generated or caused under a state in which abutment occurs in one direction. However, the sliding direction is reversed at the position at which the rotation angle of the protrusion shaft 101*a* is A° so that the side regulating plates 82 are slid in the direction of widening the space between the side regulating plates 82R and 82L. Then, the assembly play between the intermediate components, the backlash between the gears meshing with each other, or the deflection of the component, which is caused by the force applied to the side regulating plates 82, which has been generated or caused under a state in which abutment occurs in the one direction, is temporarily eliminated or released. Then, when the space between the side regulating plates 82R and 82L is gradually widened, the assembly play between the intermediate components, the backlash between the gears meshing with each other, or the deflection of the component, which is caused by the force applied to the side regulating plates 82, is generated or caused under a state in which abutment occurs in a direction opposite to the one direction. Meanwhile, the side regulating plates 82 and the intermediate components are being moved. However, the motions are not transmitted to the variable resistor of the width sensor 101, and the idling is caused thereby. As a result, the rotation angle of the protrusion shaft 101*a* remains unchanged at A°. At this time, although the space between the side regulating plates 82R and 82L is being changed in the direction of being widened, the rotation angle of the protrusion shaft 101*a* of the width sensor 101 remains unchanged at A°. Thus, the error between the output voltage of the width sensor 101, which is output in accordance with the rotation angle of the protrusion shaft 101*a*, and the output voltage represented as the ideal straight line increases in the positive direction. Further, the output voltage of the width sensor 101 is output to the CPU 106 (see FIG. 11) of the control portion (not shown). Because the output voltage of the width sensor 101 does not change, the CPU 106 erroneously detects that the width of the recording material P is still narrow. As described above, the error generated when the side regulating plates 82 are operated in the direction of widening the space between the side regulating plates 82R and 82L is larger than the error generated when the side regulating plates 82 are operated in the direction of narrowing the space between the side regulating plates 82R and 82L.

In this case, the change in error, which may be caused when the side regulating plates 82 are operated in the direction of narrowing the space between the side regulating plates 82R and 82L and the error with respect to the true recording material width is small, has been described with reference to the graph of FIG. 10. The factors, which may generate the error with respect to the true recording material width, include, as described above, the assembly play between the intermediate components, the backlash between the gears meshing with each other, and the deflection of the component, which is caused by the force applied to the side regulating plates 82. In FIG. 10, the error with respect to the true recording material width, which is generated when the side regulating plates 82 are operated in the direction of widening the space between the side regulating plates 82R and 82L, is larger than the error with respect to the true recording material width, which is generated when the side regulating plates 82 are operated in the direction of narrowing the space between the side regulating plates 82R and 82L. However, even when the factors, which may generate the error with respect to the true recording material width, are the same, the error with respect to the true recording material width, which is generated when the side regulating plates 82 are operated in the direction of narrowing the space between the side regulating plates 82R and 82L, is larger than the error, which is generated when the side regulating plates 82 are operated in the direction of widening the space between the side regulating plates 82R and 82L, in some cases.

[System Configuration for Detecting Recording Material Width]

Figure 11:
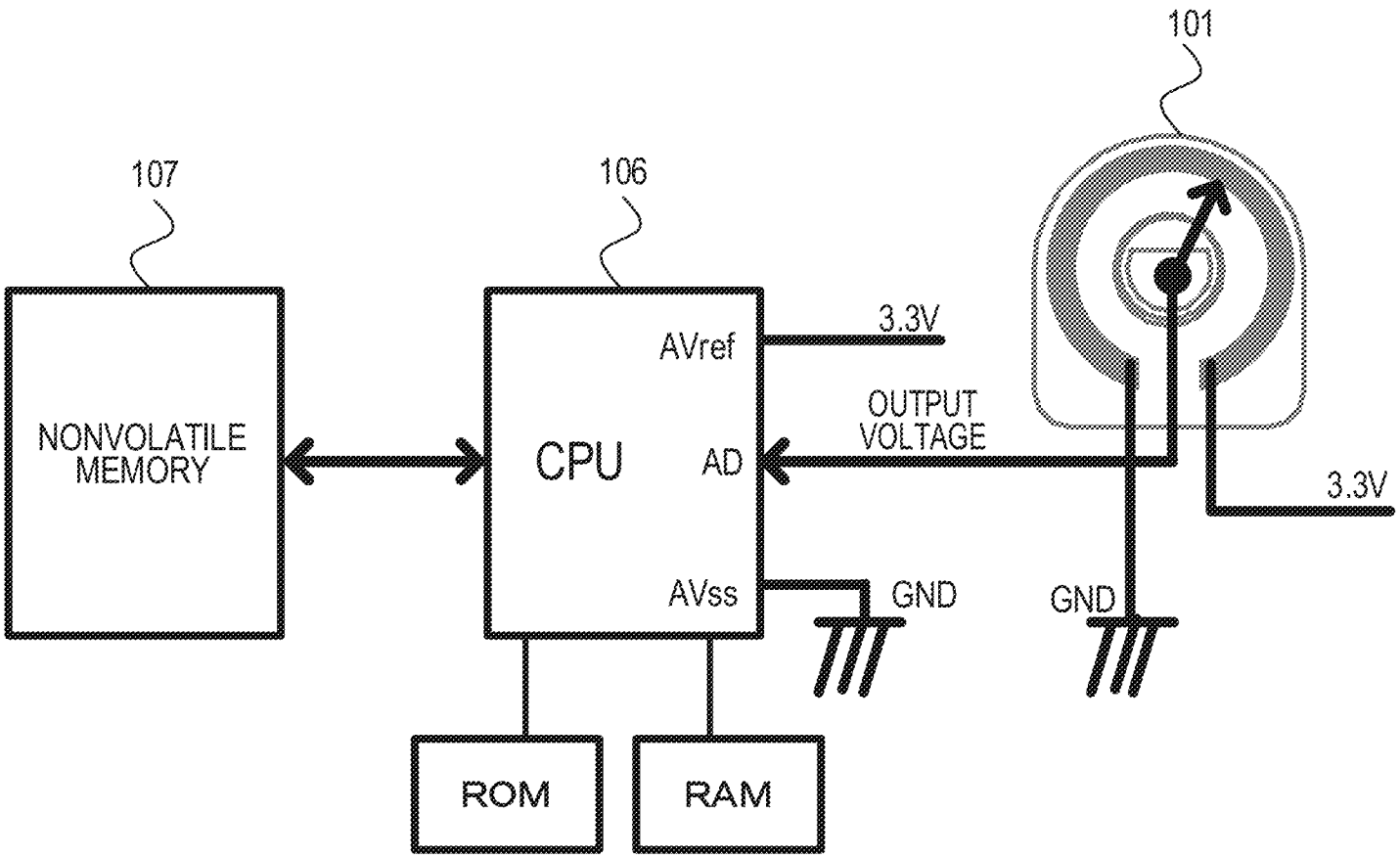
FIG. 11 is a diagram for illustrating a system configuration for detecting the width of the recording material according to the embodiment.

FIG. 11 is a diagram for illustrating a system configuration of the printer 1 according to this embodiment, for detecting the width of the recording material P. In FIG. 11, the CPU 106 of the control portion includes a ROM and a RAM, which correspond to storage devices, and is configured to collectively control the image formation operation of the printer 1 with use of the RAM as a work area based on various control programs stored in the ROM. Further, in FIG. 11, the CPU 106 has three terminals, specifically, an AVref terminal, an AD terminal, and an AVss terminal. A DC voltage of 3.3 volts (V), which is a maximum value of the output voltage from the width sensor 101, is input to the AVref terminal. The AVss terminal is connected to a ground (GND) at 0 V, which is a minimum value of the output voltage. The output voltage in accordance with the rotation angle of the protrusion shaft 101*a* of the width sensor 101 is input from the width sensor 101 of the recording-material width detection unit 100 to the AD terminal. The CPU 106 converts the output voltage (analog voltage) of the width sensor 101, which has been input to the AD terminal corresponding to an AD conversion input port, into a digital value in accordance with the output voltage. Further, the CPU 106 is connected to a nonvolatile memory 107 corresponding to a storage unit, and accesses the nonvolatile memory 107 to read out and write data.

[Correction Processing for Recording Material Width]

An intended or predetermined dimension of each of the intermediate components provided to transmit the motions of the side regulating plates 82 to the variable resistor of the width sensor 101 and a specification value (ideal value without an error) of the change amount of the resistance value with respect to the rotation amount of the protrusion shaft of the variable resistor are part of a stage of designing. Thus, the CPU 106 can uniquely calculate the width of the recording material P based on a mathematical expression using the digital value (hereinafter referred to as "AD conversion value") acquired by AD conversion of the output voltage from the width sensor 101 and predetermined parameters such as the intended dimension of each of the components and the specification value. The width of the recording material, which is calculated by the mathematical expression as described above, is herein referred to as "ideal recording material width". However, the "static error" and the "dynamic error" are not taken into consideration for the ideal recording material width, and the ideal recording material width is different from the "true recording material width" for which the static error and the dynamic error are taken into consideration.

Figure 12:
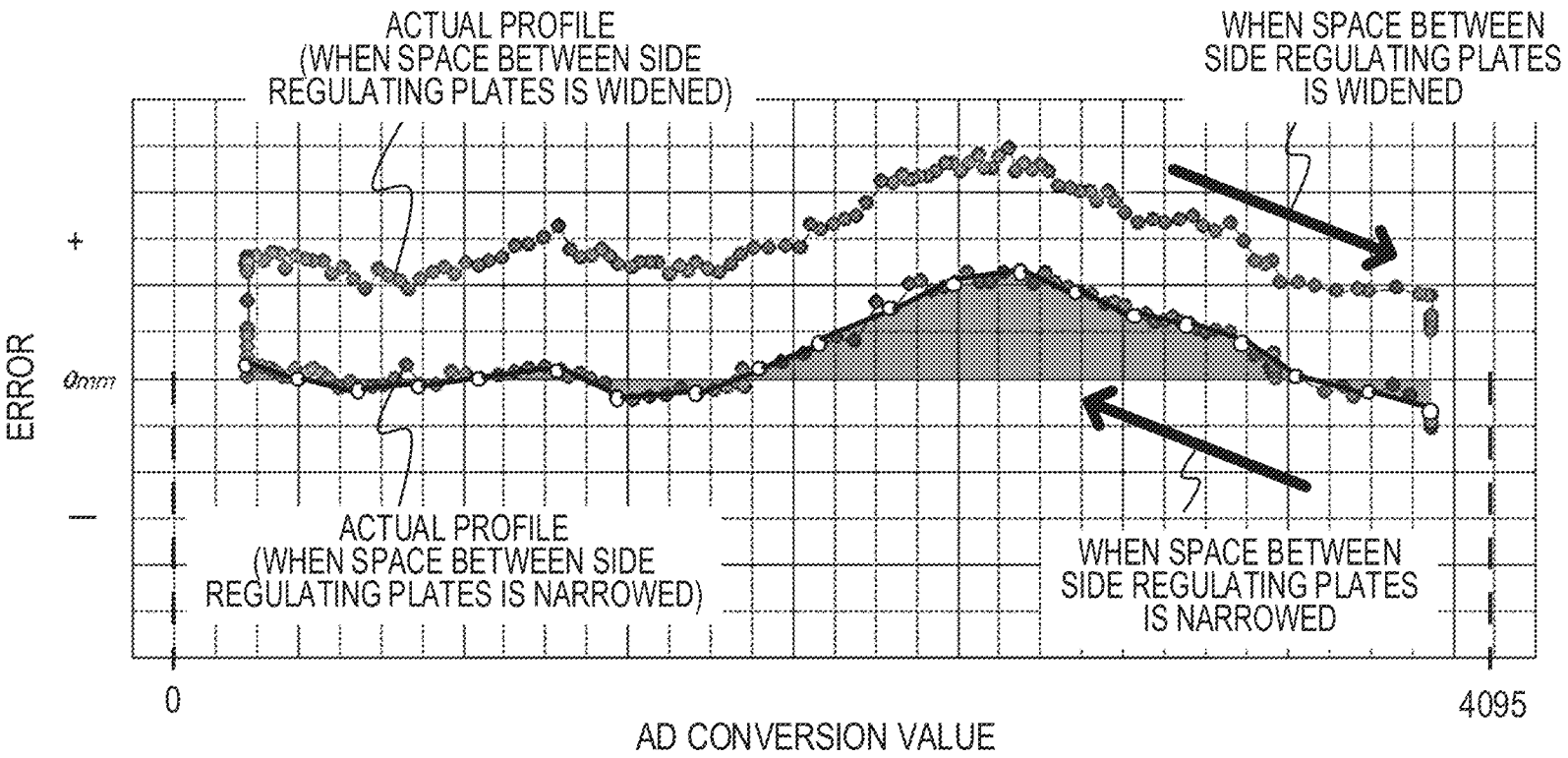
FIG. 12 is a graph for showing an error between an AD conversion value of the output voltage of the recording-material width sensor according to the embodiment and the actual recording material width.

Subsequently, correction processing for performing correction in consideration of the "static error" and the "dynamic error" for the "ideal recording material width" to calculate the "true recording material width" is described. FIG. 12 is a graph having the horizontal axis representing the AD conversion value in place of the output value of the width sensor 101, which is represented on the horizontal axis of the graph of FIG. 9. In FIG. 12, a line that connects white dots is obtained by connecting twenty pieces of data represented as the white dots in profile data obtained when the side regulating plates 82 are slid in the direction of narrowing the space from the maximum width side of the recording material P toward the minimum width side. In this embodiment, a resolution of the AD conversion is set to 12 bits, and a range of the output voltage of the width sensor 101 from 0 V to 3.3 V is converted into a range of the AD conversion value from 0 to 4095 ($=2^{12}-1$). Further, in this embodiment, data such as the AD conversion value obtained when the side regulating plates 82 are slid from the maximum width side of the recording material P (side where the AD conversion value is 4095) toward the minimum width side of the recording material P (side where the AD conversion value is 0) is stored in advance in the nonvolatile memory 107. The data may be stored in the nonvolatile memory 107 in, for example, an assembly step for the printer 1.

The reason why the data obtained when the side regulating plates 82 are slid in the direction of narrowing the space between the side regulating plates 82R and 82L is stored in the nonvolatile memory 107 is as follows. Specifically, when the recording material P is set in the feed tray 83, the user adjusts the positions of the side regulating plates 82 so that the space therebetween becomes larger than the width of the recording material P that is intended or predetermined to be set, and then sets the recording material P in the feed tray 83. Then, after setting the recording material P in the feed tray 83, the user slides the side regulating plates 82 so that both of the side regulating plates 82R and 82L abut against the edges of the recording material P in the width direction without leaving any gap. When the recording material P is set in the feed tray 83, the above-mentioned operation is generally performed. This is the reason why the data obtained when the side regulating plates 82 are slid in the direction of narrowing the space between the side regulating plates 82R and 82L is stored in the nonvolatile memory 107.

Figure 13:
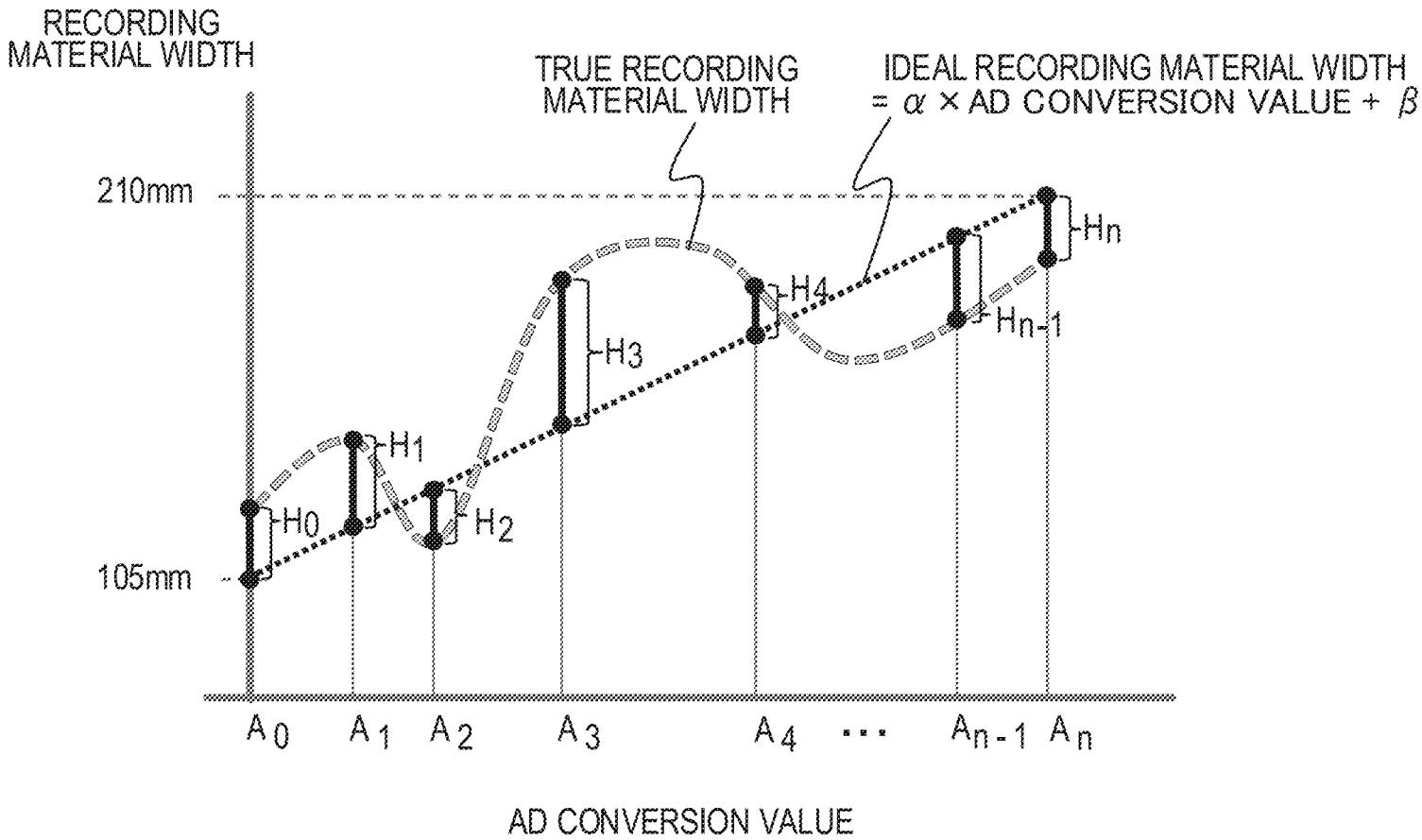
FIG. 13 is a graph for showing correction processing according to the embodiment.

FIG. 13 is a graph for showing the line that connects the white dots plotted in FIG. 12 in a simplified manner. The horizontal axis of FIG. 12 represents the AD conversion value, and the vertical axis represents the error between "IDEAL RECORDING MATERIAL WIDTH" calculated based on the AD conversion value and "TRUE RECORDING MATERIAL WIDTH" for which the "static error" and the "dynamic error" are taken into consideration. In FIG. 13, the horizontal axis represents the AD conversion value, and the vertical axis represents the width of the recording material P. In FIG. 13, a straight dotted line represents "IDEAL RECORDING MATERIAL WIDTH" calculated based on the AD conversion value (such as $A_0$ and $A_1$). In this embodiment, the "ideal recording material width" is calculated by a linear equation: $\alpha\times$AD conversion value$+\beta$ (in which the parameters $\alpha$ and $\beta$ are predetermined). Meanwhile, a curved broken line represents "TRUE RECORDING MATERIAL WIDTH". Differences (such as $H_0$ and $H_1$) between "IDEAL RECORDING MATERIAL WIDTH" and "TRUE RECORDING MATERIAL WIDTH", each indicated by a thick black straight line, correspond to the error represented on the vertical axis of FIG. 12.

Ideal recording material width data based on the AD conversion value and difference data (difference information) between the ideal recording material width data and true recording material width data are stored in the nonvolatile memory 107 in association with each other. The data is stored in the nonvolatile memory 107 in the following manner. First, a plurality of (for example, (n+1)) representative points of the AD conversion value are extracted while the side regulating plates 82, which are in a state of having a maximum space therebetween, are being slid in the direction of narrowing the space between the side regulating plates 82R and 82L. Then, the thus extracted (n+1) AD conversion values ($A_0$, $A_1$, . . . , $A_{n-1}$, $A_n$) and (n+1) pieces of error data ($H_0$, $H_1$, . . . , $H_{n-1}$, $H_n$) corresponding to the (n+1) AD conversion values are stored in the nonvolatile memory 107. In this case, the error data $H_n$ has a value obtained by subtracting the "ideal recording material width" calculated based on the AD conversion value described above from the "true recording material width". Thus, in FIG. 13, each of the error data $H_0$ and $H_1$ has a positive value, and the error data $H_2$ has a negative value. Further, the "true recording material width" can be calculated by actually measuring the space between the side regulating plates 82R and 82L. Meanwhile, the "ideal recording material width" can be uniquely calculated by the linear equation of the AD conversion value and the predetermined parameters as described above. In this embodiment, the "ideal recording material width" is calculated by the linear equation: "α×AD conversion value+β" using the predetermined parameters α and β.

Figure 14:
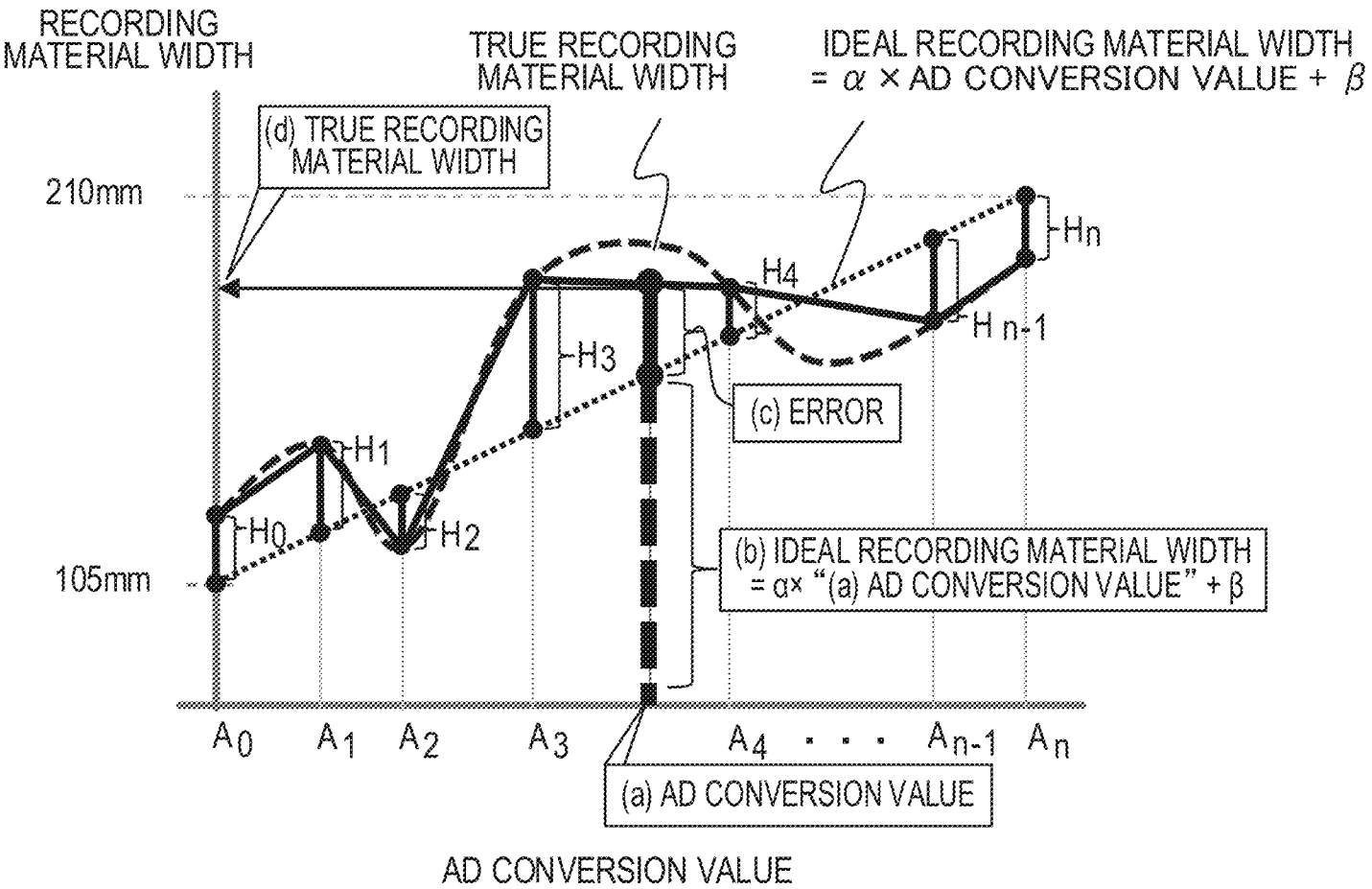
FIG. 14 is a graph for showing the correction processing according to the embodiment.

Next, a method in which the CPU 106 calculates the "true recording material width" with use of the data values stored in the nonvolatile memory 107 is described with reference to FIG. 14. FIG. 14 is a graph for showing a method of calculating the "true recording material width" based on the graph of FIG. 13. In this case, a user places the recording material P of a given size in the feed tray 83, and slides the side regulating plates 82 to adjust the positions of the side regulating plates 82R and 82L so that the side regulating plates 82R and 82L abut against the edges of the recording material P in the width direction. The CPU 106 performs the AD conversion on the output voltage, which is output from the width sensor 101 based on the rotation angle of the protrusion shaft portion 101*a* and input to the AD terminal, to acquire "(a) AD CONVERSION VALUE". Then, the CPU 106 calculates "(b) IDEAL RECORDING MATERIAL WIDTH" by substituting "(a) AD CONVERSION VALUE" into the above-mentioned linear equation "α×AD conversion value+β". In this embodiment, the linear equation "α×AD conversion value+β" is stored in advance in the nonvolatile memory 107, and the CPU 106 reads out the linear equation as needed to calculate "(b) IDEAL RECORDING MATERIAL WIDTH". In this case, the linear equation "α×AD conversion value+β" is stored in advance in the nonvolatile memory 107. However, the linear equation may be contained in a program, which is stored in the ROM and is to be executed by the CPU 106.

Next, the CPU 106 calculates "(c) ERROR" between "(d) TRUE RECORDING MATERIAL WIDTH" and "(b) IDEAL RECORDING MATERIAL WIDTH". Now, a method of calculating "(c) ERROR" is described. In this embodiment, "(c) ERROR" is calculated using the AD conversion value stored in the non-volatile memory 107, the AD conversion values at two points in the vicinity of "(a) AD CONVERSION VALUE", which are included in error data corresponding to the AD conversion values and are adjacent to "(a) AD CONVERSION VALUE" on both sides, and the error data corresponding to the AD conversion values. More specifically, the CPU 106 determines two AD conversion values in the vicinity of "(a) AD CONVERSION VALUE", which are adjacent thereto on both sides, from the AD conversion values ($A_0$, $A_1$, . . . , $A_{n-1}$, $A_n$) stored in the nonvolatile memory 107. In FIG. 14, the two AD conversion values correspond to the AD conversion values $A_3$ and $A_4$. Next, the CPU 106 acquires the error data corresponding to the determined AD conversion values from the error data ($H_0$, $H_1$, . . . , $H_{n-1}$, $H_n$) stored in the nonvolatile memory 107. In FIG. 14, the error data $H_3$ and $H_4$ correspond to the error data corresponding to the AD conversion values $A_3$ and $A_4$. Then, the CPU 106 performs linear interpolation of the error data $H_3$ and $H_4$ between the AD conversion values $A_3$ and $A_4$ to obtain "(c) ERROR" at "(a) AD CONVERSION VALUE". Then, the CPU 106 adds "(c) ERROR" to "(b) IDEAL RECORDING MATERIAL WIDTH" to calculate "(d) TRUE RECORDING MATERIAL WIDTH". In the above-mentioned manner, the CPU 106 can calculate "(d) TRUE RECORDING MATERIAL WIDTH".

Figure 15:
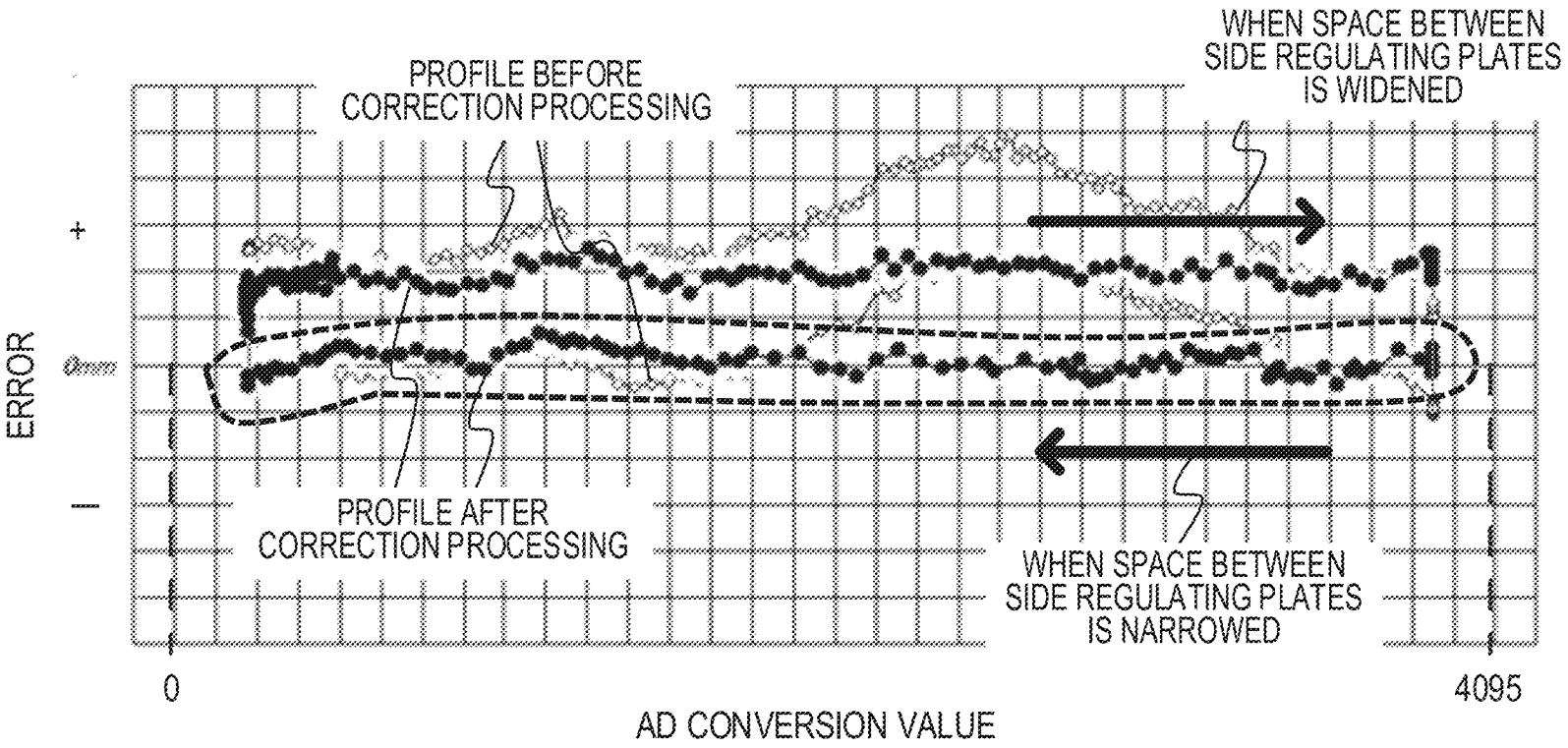
FIG. 15 is a graph for showing the AD conversion values before and after the correction processing according to the embodiment and an error between a true recording material width and an ideal recording material width.

FIG. 15 is a graph for showing the AD conversion values before and after the correction processing described with reference to FIG. 14 and the error between the true recording material width and the ideal recording material width. In FIG. 15, each line that connects gray dots is a profile representing the AD conversion value before the correction processing and the error between the true recording material width and the ideal recording material width. Meanwhile, each line that connects black dots is a profile representing the AD conversion value after the correction processing and the error between the true recording material width and the ideal recording material width. In this embodiment, data obtained when the side regulating plates 82R and 82L are moved in the direction of narrowing the space between the side regulating plates 82R and 82L is stored in the nonvolatile memory 107, and the correction processing is performed based on the stored data. Thus, in FIG. 15, the profile of the error generated when the side regulating plates 82 are slid in the direction of narrowing the space between the side regulating plates 82R and 82L (in a region surrounded by the broken line in FIG. 15) has a value substantially close to 0 mm. Meanwhile, the profile of the error generated when the side regulating plates 82 are slid in the direction of widening the space between the side regulating plates 82R and 82L is obtained by adding the dynamic error to the error represented by the profile of the error generated when the side regulating plates 82 are slid in the direction of narrowing the space between the side regulating plates 82R and 82L.

In this embodiment, there has been described the example in which the data for correction for a case in which the side regulating plates 82 are slid in the direction of narrowing the space between the side regulating plates 82R and 82L, is stored in the nonvolatile memory 107. The data to be stored in the nonvolatile memory 107 is not limited to the data for the case in which the side regulating plates 82 are slid in the direction of narrowing the space between the side regulating plates 82R and 82L. For example, the data for correction for a case in which the side regulating plates 82 are slid in the direction of widening the space between the side regulating plates 82R and 82L, may be stored in the nonvolatile memory 107. In this case, the side regulating plates 82 are operated in the direction of widening the space between the side regulating plates 82R and 82L. The width of the recording material P placed in the feed tray 83 is calculated based on the output voltage of the width sensor 101 at the time of operation of the side regulating plates 82.

As described above, according to this embodiment, in consideration of the "static error" and the "dynamic error", the size of the recording material can be detected with high accuracy.

OTHER EMBODIMENTS (Correction Processing for Recording Material Width)

In the embodiment described above, as described above with reference to FIG. 14, the correction processing for calculating "(d) TRUE RECORDING MATERIAL WIDTH" as the sum of "(b) IDEAL RECORDING MATERIAL WIDTH" and "(c) ERROR" is performed. In this manner, the profiles representing the relationship between the AD conversion value after the correction processing and the error, which are shown in the graph of FIG. 15, are obtained. However, the data obtained when the space between the side regulating plates 82R and 82L is narrowed is stored in the nonvolatile memory 107. Thus, the error after the correction processing may be different depending on the direction of sliding the side regulating plates 82.

Figure 16:
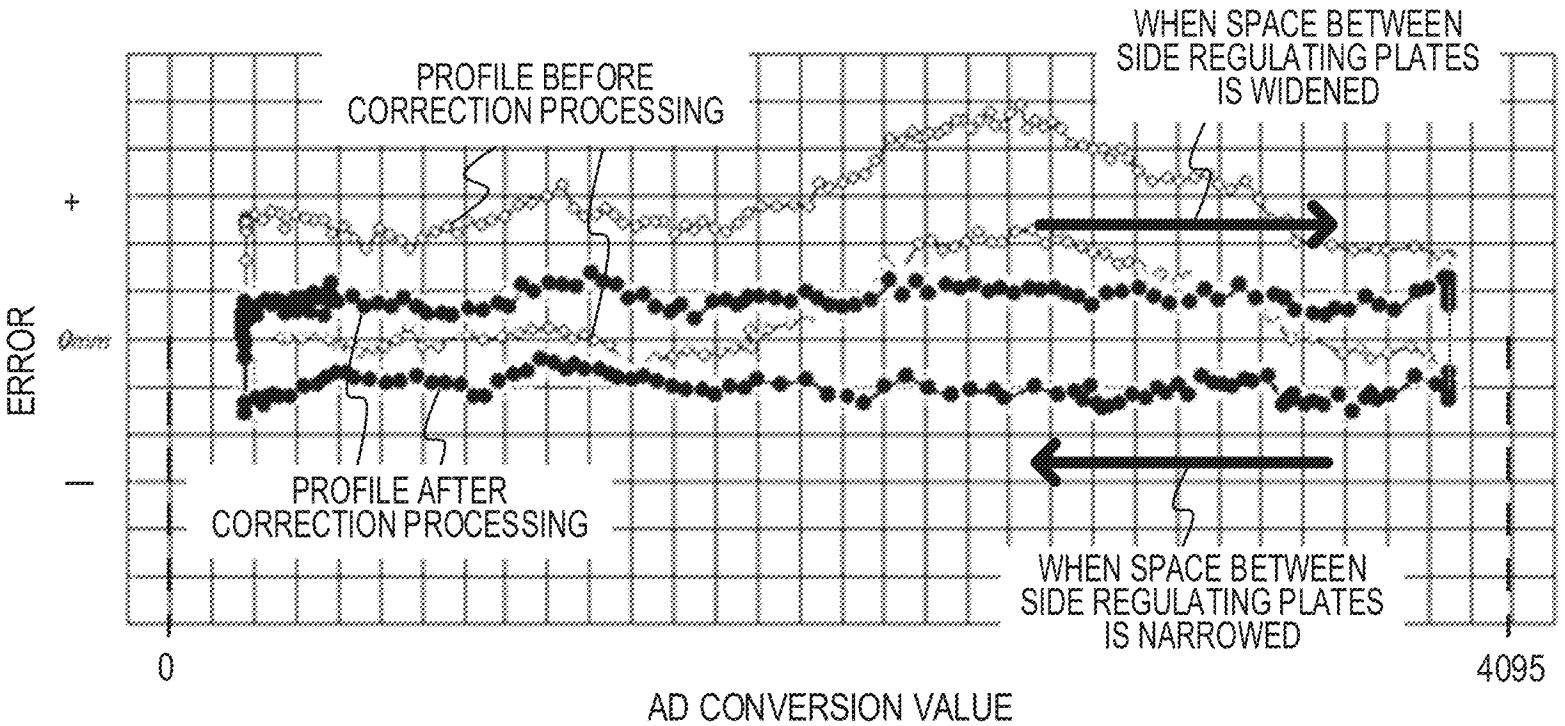
FIG. 16 is a graph for showing the AD conversion values before and after correction processing according to another embodiment and the error between the true recording material width and the ideal recording material width.

Thus, a value of the "dynamic error" is measured in advance. After the above-mentioned correction processing is performed, and one half of the "dynamic error" is subtracted to thereby calculate the true recording material width. Specifically, when "(d) TRUE RECORDING MATERIAL WIDTH" is to be obtained, "(d) TRUE RECORDING MATERIAL WIDTH" is calculated by: "(b) IDEAL RECORDING MATERIAL WIDTH"+"(c) ERROR"−("dynamic error"÷2). As a result, a "dynamic error" amount can be evenly distributed as the error generated when the side regulating plates 82 are narrowed and the error generated when the side regulating plates 82 are widened. FIG. 16 is a graph for showing the AD conversion values before and after the correction processing described above and the error between the true recording material width and the ideal recording material width. In FIG. 16, each line that connects gray dots represents the AD conversion value before the correction processing and the error between the true recording material width and the ideal recording material width. Meanwhile, each line that connects black dots represents the AD conversion value after the correction processing and the error between the true recording material width and the ideal recording material width. As shown in FIG. 16, it is understood that the "dynamic error" amount is evenly distributed to the profile of the error generated when the side regulating plates 82 are narrowed and the profile of the error generated when the side regulating plates 82 are widened, through the correction described above.

(Configuration of Recording Material Width Sensor)

Figure 17A:
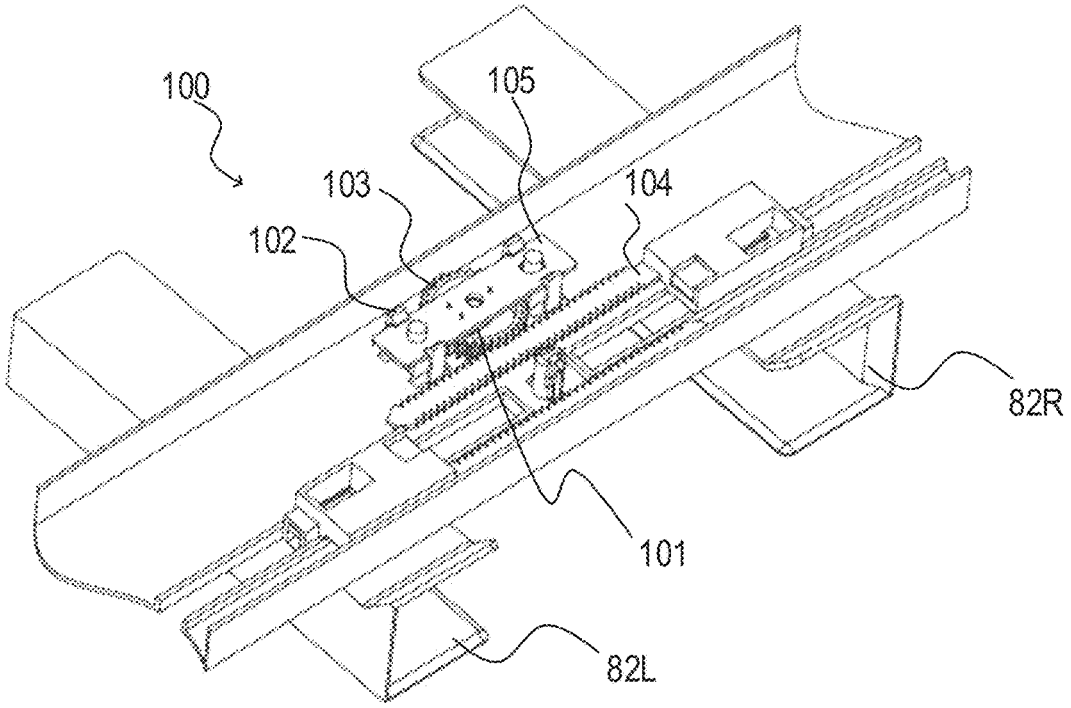
FIG. 17A and FIG. 17B are views, each for illustrating a configuration of a recording-material width detection unit according to still another embodiment.
Figure 17B:
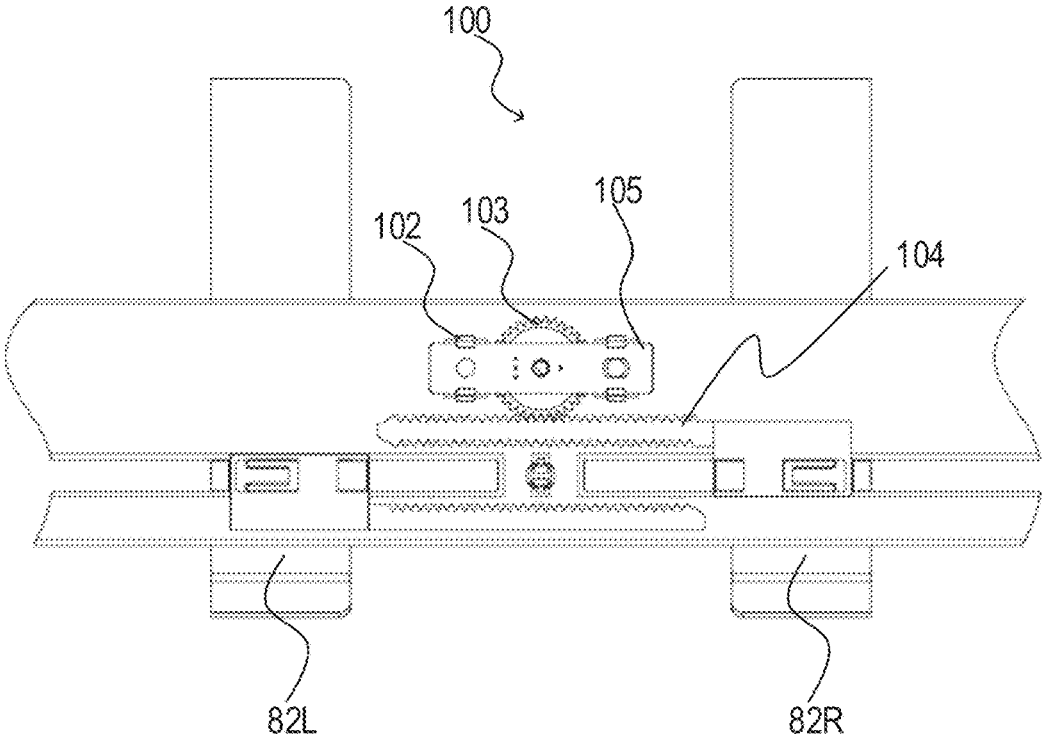

In the embodiment described above, as illustrated in FIG. 3A, the width sensor 101 is arranged so that the longitudinal direction thereof is orthogonal to the recording material P placed in the feed tray 83. However, the width sensor 101 may be arranged in parallel to the recording material P. FIG. 17A and FIG. 17B are a perspective view (FIG. 17A) and a top view (FIG. 17B), each for illustrating a configuration of the recording-material width detection unit 100 in which the width sensor 101 is arranged in parallel to the recording material P placed in the feed tray 83 and a relationship between the recording-material width detection unit 100 and the side regulating plates 82.

In FIG. 17A and FIG. 17B, the recording-material width detection unit 100 includes the printed board 105 and the sensor gear 103. The width sensor 101 is mounted onto the printed board 105. The printed board 105 is mounted to the width sensor holder 102. In the embodiment described above, the width sensor 101 is mounted to the surface of the printed board 105 on the side opposite to the sensor gear 103. The configuration illustrated in FIG. 17A and FIG. 17B is different in that the width sensor 101 is provided between the printed board 105 and the sensor gear 103. As illustrated in FIG. 17A, the width sensor 101 is installed in parallel to an upper surface of the recording material P (not shown in FIG. 17A and FIG. 17B) placed between the side regulating plates 82R and 82L.

As in the embodiment described above, the sensor rack 104 is connected to the side regulating plate 82R in the following manner. When the side regulating plate 82R is operated so as to abut against the corresponding edge of the recording material P in the width direction after the reception of the recording material P in the feed tray 83, the sensor rack 104 is slid in association with the movement of the side regulating plate 82R. For example, when the side regulating plate 82R is slid in a rightward direction in FIG. 17B, the sensor rack 104 is also slid in the rightward direction and the sensor gear 103 is rotated in a counterclockwise direction in FIG. 17B. Meanwhile, when the side regulating plate 82R is slid in a leftward direction in FIG. 17B, the sensor rack 104 is also slid in the leftward direction and the sensor gear 103 is rotated in a clockwise direction in FIG. 17B. Then, the sensor gear 103 has the rotary shaft as in the embodiment described above, and the rotary shaft is fitted into the hole formed in the protrusion shaft 101*a* of the width sensor 101. The width sensor 101 is rotated in accordance with the rotation of the sensor gear 103, and outputs the output voltage in accordance with the rotation angle to the CPU 106. The CPU 106 can precisely detect the width size of the recording material P placed in the feed tray 83 based on the AD conversion value obtained by converting the output voltage from the width sensor 101 and the correction data stored in the nonvolatile memory 107.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-127062, filed Jul. 8, 2019, which is hereby incorporated by reference herein in its entirety.

What is claimed is:

1. An image forming apparatus comprising:

a control unit configured to control an image formation on a recording material;

a stack portion on which the recording material is to be stacked;

a regulation portion configured to regulate a position of an edge of the recording material stacked on the stack portion;

a detection unit configured to detect the position of the edge of the recording material regulated by the regulation portion, and to output a detection signal, having a value, in accordance with the detected position of the edge; and a storage unit configured to store difference information in association with values of the detection signal, wherein the difference information is calculated in advance by the control unit as a difference between a first width of the recording material, which is calculated based on the detection signal output from the detection unit, and second width of the recording material which is measured, wherein the control unit is configured to calculate difference information in accordance with the value of the detection signal output from the detection unit by reading out two values of the detection signal, which are previously stored in the storage unit and immediately adjacent the value of the detection signal output from the detection unit, and difference information, which are associated with the two values, respectively, from the storage unit, and performing linear interpolation in accordance with the value of the detection signal output from the detection unit, and wherein the control unit is configured to obtain a third width of the recording material by correcting the first width of the recording material based on the difference information calculated by the control unit in accordance with the value of the detection signal output from the detection unit.

2. The image forming apparatus according to claim 1, wherein the control unit is configured to obtain the third width of the recording material by adding the difference information calculated by the control unit in accordance with the value of the detection signal output from the detection unit, to the first width of the recording material.

3. The image forming apparatus according to claim 2, wherein the regulation portion includes:

a first regulating member configured to regulate a position of one edge of the recording material in a width direction orthogonal to a conveying direction of the recording material, and a second regulating member, which is to be moved in a direction opposite to an operating direction of the first regulating member, and is configured to regulate a position of another edge of the recording material in the width direction.

4. The image forming apparatus according to claim 3, further comprising a rack configured to be moved integrally with the first regulating member, wherein the detection unit includes a gear, which is to be meshed with the rack, and is configured to perform width detection, and includes a rotary variable resistor which includes a shaft to be coupled to the gear and of which a resistance value is changed in accordance with a rotation angle of the shaft, and wherein the detection unit is configured to output, as the detection signal, a voltage in accordance with the resistance value of the rotary variable resistor.

5. The image forming apparatus according to claim 4, wherein the control unit is configured to calculate, by the voltage and a linear equation using the voltage, the first width of the recording material stacked on the stack portion before a correction is performed.

6. The image forming apparatus according to claim 5, wherein, in a case where the detection signal is output from the detection unit when the regulation portion is operated in a direction of widening a space between the first regulating member and the second regulating member, the storage unit stores a value of the detection signal output from the detection unit when the regulation portion is operated and stores difference information associated with the stored value of the detection signal.

7. The image forming apparatus according to claim 5, wherein, in a case where the detection signal is output from the detection unit when the regulation portion is operated in a direction of narrowing a space between the first regulating member and the second regulating member, the storage unit stores a value of the detection signal output from the detection unit when the regulation portion is operated and stores difference information associated with the stored value of the detection signal.

8. The image forming apparatus according to claim 7, wherein difference information when the regulation portion is operated in a direction of widening a space between the first regulating member and the second regulating member is smaller than the difference information when the regulation portion is operated in the direction of narrowing the space between the first regulating member and the second regulating member.

9. The image forming apparatus according to claim 7, wherein the difference information when the regulation portion is operated in the direction of narrowing the space between the first regulating member and the second regulating member is smaller than difference information when the regulation portion is operated in a direction of widening the space between the first regulating member and the second regulating member.

10. The image forming apparatus according to claim 9, wherein a difference between the difference information when the regulation portion is operated in the direction of narrowing the space between the first regulating member and the second regulating member and the difference information when the regulation portion is operated in the direction of widening the space between the first regulating member and the second regulating member is generated by a gap between intermediate components provided so as to transmit, from the first regulating member, a moving amount of the first regulating member, which is generated by an operation of the regulation portion, to the gear and deformation of each intermediate component, which is caused by a force applied to the first regulating member through the operation of the regulation portion.

11. The image forming apparatus according to claim 10, wherein the control unit is configured to obtain the third width of the recording material by subtracting (i) one half of the difference between the difference information when the regulation portion is operated in the direction of narrowing the space between the first regulating member and the second regulating member and the difference information when the regulation portion is operated in the direction of widening the space between the first regulating member and the second regulating member from (ii) a value calculated by adding, to the first width of the recording material, the difference information calculated by the control unit in accordance with the value of the detection signal output from the detection unit.

* * * * *